US005610986A

United States Patent [19]

Miles

[11] Patent Number: 5,610,986

[45] Date of Patent: Mar. 11, 1997

[54] LINEAR-MATRIX AUDIO-IMAGING SYSTEM AND IMAGE ANALYZER

[76] Inventor: Michael T. Miles, 1826 S. Third St., Niles, Mich. 49120

[21] Appl. No.: 206,767

[22] Filed: Mar. 7, 1994

[51] Int. Cl.[6] ..... H04R 5/00

[52] U.S. Cl. ..... 381/27; 381/1; 381/18; 381/19

[58] Field of Search ..... 381/17, 24, 1, 381/18, 19, 27

[56] References Cited

U.S. PATENT DOCUMENTS

| | | | |
|---|---|---|---|
| 3,746,792 | 7/1973 | Scheiber . | |
| 3,757,046 | 9/1973 | Williams | 381/24 |
| 4,132,859 | 1/1979 | Ranga . | |
| 4,399,328 | 8/1983 | Franssen | 381/1 |
| 4,472,834 | 9/1884 | Yamamuro | 381/24 |
| 4,612,663 | 9/1986 | Holbrook | 381/24 |
| 4,703,502 | 10/1987 | Kasai et al. . | |
| 4,819,269 | 4/1989 | Klayman . | |
| 5,119,422 | 6/1992 | Price . | |
| 5,197,100 | 3/1993 | Shiraki | 381/24 |

OTHER PUBLICATIONS

Gerzon, Michael A., "Optimum Reproduction Matrices for Multispeaker Stereo," *Journal of the Audio Engineering Society, Audio/Acoustics/Applications*, vol. 40, No. 7/8, pp. 571–589, Jul./Aug., 1992.

Lackey, Robert B., Hull, John W. and Colson, Henry D., "Three-Channel Audio Recording and Playback Via Two-Channel Transmission with Absolute Minimum Cross-Talk," *Audio Engineering Society Preprint* 1293, 58th Convention, pp. 1–6, Nov. 4–7, 1977.

Bauer, Benjamin B., "Some Techniques Toward Better Stereophonic Perspective," *IEEE Transactions on Audio*, pp. 88–92, May/Jun., 1963.

Bauer, Benjamin B., "Phasor Analysis of Some Stereophonic Phenomena," *The Journal of the Acoustical Society of America*, vol. 33, No. 11, pp. 1536–1539, Nov., 1961.

Klipsch, Paul W., "Derived Three Channel Playback of Two-Track Stereo Using Three Microphones," pp. 10–12.

Klipsch, Paul W., "Circuits for Three-Channel Stereophonic Playback Derived From Two Sound Tracks," *IRE Transactions on Audio*, pp. 161–165, Nov./Dec., 1959.

*Primary Examiner*—Curtis Kuntz
*Assistant Examiner*—Minsun Oh
*Attorney, Agent, or Firm*—Van Dyke, Gardner, Linn & Burkhart, LLP

[57] ABSTRACT

An audio-imaging system includes at least first and second input channels for receiving first and second channel audio input signals and at least first, second and third output signals which are produced as a combination of the first and second channel audio input signals and a nonzero parameter. The parameter is common to the first, second and third output signals and may be made adjustable in order to vary the width of the audio image produced in order to compensate for composition mixing of a program source applied to the input channels. A sound-image analyzer is also provided which processes a program source applied to the input channels to at least three fully separated levels representing left, right and center directions of the program source in order to determine a value of the parameter.

38 Claims, 21 Drawing Sheets

25

25"

25b

LINEAR-MATRIX AUDIO-IMAGING SYSTEM AND IMAGE ANALYZER

BACKGROUND OF THE INVENTION

This invention relates to audio-imaging systems and, in particular, to such systems which may be used with a stereo source to provide frontal imaging with or without ambient sound. The invention may also be applied to three or four channel sources in order to produce true full-direction imaging.

Systems with three recorded channels of audio, used to drive left, center, and right speakers, can produce a significantly superior, more realistic, or more accurate front-stereo image over a wide range of listening positions. While this format is typically utilized for film soundtracks, other recorded formats such as CD, cassette, radio, and video, utilize only two program channels, one intended for a left speaker and the other for a right speaker. This approach of recording just two channels for program distribution is established as a cost-effective compromise for distribution of stereo audio program material.

The standard sound reproduction implementation, which uses two speakers, left and right, to reproduce the program has serious limitations in imaging capability. In particular, it is necessary for the listener to be located in a specific area equidistant from the speakers in order to achieve the desired imaging performance. If the listener is off-center, then the sound of the nearer speaker dominates and distorts the stereo image. Existing audio-imaging schemes for a two-channel source do not effectively address this particular problem. There are other problems with existing two-speaker systems, such as the inferior phantom-source definition compared to direct-source definition, effects of room acoustics, and necessary close speaker matching, all of which can result in image distortion. The present invention is intended to address all of these problems using a third speaker, appropriate speaker placement, and an optimized matrix system used for deriving the outputs.

Systems have been designed to utilize three speakers to reproduce a stereo program source, but with various limitations. In one of the earlier published approaches, Klipsch, "Circuits for Three-Channel Stereophonic Playback Derived From Two Sound Tracks," *IRE Transactions*, November–December 1959, incorporates a left-plus-right sum signal, or for specially-made recordings, a difference signal, to drive a center speaker which is placed between the left and right speakers. In his system, the left and right speakers are driven directly with the left and right program signals. While the left-right sum signal provides viable means of creating an appropriate center channel, this approach compromises the left-right separation and degrades the overall imaging performance under most conditions.

Further developments published by B. B. Bauer, "Phasor Analysis of Some Stereophonic Phenomena," *J. Acous. Soc. Am.*, Vol. 33, No. 11, November, 1961, p 1536, suggest that, to a large degree, two-channel stereo imaging can be explained using phasor analysis, treating each of the two acoustic sources as producing vector signals which can be added together resulting in a sum vector representing a phantom image which seems to arrive to the listener from a direction other than that of either speaker. This explains the effectiveness of an amplitude-panning potentiometer in placing a sound-source location between two speakers, as well as the ability to create sound-source locations outside the area between the speakers, using an inverted signal of appropriate amplitude on one channel. Bauer further described in "Some Techniques Toward Better Stereophonic Perspective," *IEEE Trans. Audio*, May–June 1963, a method of using phase shifting to spread a sound-source location to a wider angle, or range of location, than the theoretical point source which results from pure amplitude panning.

In Scheiber U.S. Pat. No. 3,746,792, four (typically) audio channels are encoded to two channels for recording or transmission and decoded upon playback to produce four output channels of audio information for driving four speakers. In this type of system, the speakers are placed peripherally around the listener with the intention of adding to traditional two-channel stereo, an ambient sound field which allows reproduction of the acoustic effects of the original room, or in some cases, special effects. In theory, a sound source, at any direction, may be localized by the listener. While this approach greatly expands the range of possible source locations, it does nothing to improve the front imaging; in fact it arguably degrades the localization capability of sounds intended to originate in front of the listener.

Another approach, as described by R. B. Lackey, J. W. Hull, and H. D. Colson, in "Three-Channel Audio Recording and Playback Via Two-Channel Transmission With Absolute Minimum Cross-Talk," Audio Engineering Society Preprint 1293, 58th Convention, November 4–7, 1977, derives three signals from two using a sum-difference linear matrix. This approach uses a fixed-matrix encoding and decoding process with the intent of providing depth, an added dimension, to the playback of a two-channel recording. The fixed matrix is suggested to be optimized for electrical separation using an encoding-and-decoding process, and the results are used to provide a rear-channel signal which can assist in creating a plane of sound enveloping the listener. This system does not improve the front-imaging capability of the audio system.

Another approach, as described in Ranga U.S. Pat. No. 4,132,859, uses an arrangement of speaker connection which can implement a linear matrix for driving four speakers in a surround-sound setup. This system allows proper decoding of the four-channel matrix with a special speaker connection. However it does not improve the front-imaging capability of the system.

Another triple-speaker approach to stereo imaging is described in Klayman U.S. Pat. No. 4,819,269, in which sum and difference signals are combined acoustically to create a strong center sound-source location surrounded by dual ambient-sound-field sources. This will create a mono source with ambience, but will be lacking in left-to-right separation or localization.

A theory of multi-dimensional decoding matrices has been proposed and analyzed by Michael A. Gerzon in "Optimum Reproduction Matrices for Multispeaker Stereo," *J. Audio Engineering Society*, July/August, 1992. An analysis aimed at preserving energy levels and incorporating intensity-localization theories results in frequency-dependent fixed matrix functions for a variety of multi-dimensional decoding schemes. The coefficients in this system are precisely and specifically set to satisfy a mathematical theory of energy preservation, and various psychoacoustic localization theories.

An example of an energy preservation system is described in Price U.S. Pat. No. 5,119,422. Price attempts to maintain the original mix, or balance, of various sound-source locations by maintaining an equal total energy in each speaker. Part of the goal is to maintain the original perspective, or balance of direct and ambient information. The energy preservation theory makes an assumption that the acoustic sources are uncorrelated and, thus, the amplitude of a center phantom image between two speakers is always 3 dB higher than one or the other speakers individually. This theory is based on a similar cosine-response theory used for pan controls which maintains the loudness of the resulting signal as a pan control is moved from left to right. In practice, it is rare that a recording engineer moves a pan control during a program production. In most music applications, sound-source locations are fixed. The loudness of a signal in the mix depends not on a constancy of total energy, but simply on what the recording engineer hears, since he will adjust the channel's fader to achieve the desired level.

In addition many recordings are made with center-image signals intentionally attenuated somewhat as a compromise intended to provide a degree of compatibility of the mix with monophonic playback systems. Hence, the goal of preserving equal total energy for phantom and real sources, based on a sum of individual channel energy levels, is not necessarily the ideal condition. This is especially true if the recording was made with a different number of monitor speakers than is used for playback. The energy preservation theory, further, does not adequately address discrepancies caused by the placement of speakers in the room, relative to the listening area. In particular, if the three front-imaging speakers are placed in an arc, or if the listener is relatively far from the speakers, namely further away from the speakers than the distance between the left and right speakers, then the center speaker needs to be at an equal or slightly higher level to balance correctly with the side speakers. In another situation, where the speakers are in a straight line, and the listening area is mostly closer to the speakers than the distance between the left and right speakers, then the center speaker needs to be at a slightly lower level than the side speakers to balance correctly with them.

None of the previous systems provides optimum matrix coefficients, or adjustment for them, to work effectively in providing both electrical separation and acoustic separation-enhancement, which are needed for good imaging, using typical existing stereo program material.

SUMMARY OF THE INVENTION

The invention provides improved sound imaging and distribution characteristics of an audio system. The invention is embodied in a device employing at least three speakers for the playback of a two-channel conventional stereo audio source. The invention is directed toward providing a more precise and clear front image of the reproduced sound from typical program source material, which was made using essentially standard equipment and techniques for creating an audio-image soundstage for reproduction through a two-channel recording or transmission medium.

The invention is based on a variable linear two-to-three derivation matrix in which the coefficients of combination can be adjusted and optimized by the user for a particular recording or acoustic listening situation. The design of the matrix ensures that the system will always operate optimally when correctly adjusted. The basic process element is a two-input, three-output linear polarity-and-gain matrix, which is designed for driving a three-speaker array using two original signal channels. The derived center output is preferably the exact sum of the two derived side outputs, which guarantees the maximum electrical channel separation of 6 dB, with any user-set matrix factor, when the outputs are level-balanced using the matrix-factor control.

The invention may also be applied to imaging systems utilizing more than three speakers and a range of speaker placement arrangements, which provide the appropriate acoustic interaction in the application of creating an accurate audio stereo image. The invention may also be used with audio sources including three or more channels, such as are presently available in music or theater halls, to image the audio program from these sources.

The invention further includes a unique audio-image analyzer for creating, from two-program input channels, a set of four level signals representing four parameters which characterize a stereo image. These signals may be used to drive a display or may be applied to an automatic control system, such as an audio-imaging system, to control parameters of the imaging system. These level signals have special unique properties making them especially useful for manual or automatic adjustment of the variable derivation matrix used in other aspects of the invention. This combination may be used as either a feedback or a feedforward control system to provide the most optimum setting of matrix coefficients for providing the best imaging or sound distribution performance from the particular program source in the particular acoustic environment.

The invention is embodied in an audio-imaging system, including first and second inputs for receiving first and second channel audio input signals and first, second, and third outputs for producing first, second, and third audio output signals as a function of signals applied to the first and second inputs. According to a first aspect of the invention, a circuit is provided that produces signals at each of the first, second, and third outputs as a function of a combination of the signals applied to the first and second inputs and a number. The number is common to the first, second, and third output signals. According to another aspect of the invention, such circuit produces a signal on the first output as a function of the first input signal minus the second input signal, a signal on the second output as a function of the second input signal minus the first input signal, and a signal on the third output as a function of the sum of the first mid second input signals. According to yet another aspect of the invention, such circuit produces a signal on the first output as a function of L–MR, a signal on the second output as a function of R–ML, and a signal on the third output as a function of (1–M)(L+R). L is the level of the signal applied to the first input, R is the level of the signal applied to the second input, and M is a number.

According to a further aspect of the invention, a sound-image analyzer is provided for separating and determining the audible levels of the left-located signals, the right-located signals, the center-located signals, and the surround-located signals in a program whereby the value of the number M may be adjusted in response to the levels of the signals in the program.

By accommodating a user-adjustable image-width control device, a full and immediate optimization of the matrix parameters for any stereo recording, made in any acoustic setting or control room, with any microphone technique or configuration, is possible. The same adjustment compensates also for the conditions of the user's system. The adjustment may be as simple as turning a knob until all three speakers sound at the same level. At this point, maximum electrical channel separation (6 dB) and optimum perceived acoustic-imaging results are quickly achieved, regardless of the imaging-affecting variations which occurred throughout the recording, transmission, and reproduction process. In less critical applications, once the adjustment is made, it may be left at a fixed position, representing the optimization of the derivation matrix for the individual playback-system speaker characteristics, speaker placement, and room acoustics.

This invention achieves accurate imaging without the use of any frequency or dynamic compensation or distortion. Through a simple-yet-elegant electrical and acoustic theoretical basis and inclusion of a user adjustment for optimization, the invention provides a new level of imaging accuracy when used with any program source and a very wide range of speaker behavior and room acoustics.

The present invention provides a method of creating an improved front-stereo image in an audio reproduction system, using any program source. It incorporates at least three speakers, at least a two-input to three-output linear derivation process, and provides the capability of full optimization under all conditions for a range of usable speaker setups. The full-range matrix control allows the user to optimize the matrix coefficients, and hence the image balance, for any individual program source, any speakers, and any room. An ancillary image analyzer system allows convenient and quick optimum matrix-factor adjustment.

This approach additionally incorporates the acoustic interaction of the speakers, resulting from appropriate relative orientation, to complete the imaging process and maintain good separation and imaging performance. The matrix configuration and speaker placement arrangement according to the invention provide the necessary electrical and acoustic interaction for greatly improved imaging performance. The system may be used advantageously in audio reproduction systems for providing correct sound-source localization and increasing the size of the acceptable listening area, while maintaining an optimum level of separation and soundstage image width. The concept can be extended, where necessary, to include more signal channels and, correspondingly, more speakers to cover a wider space of accurate imaging.

The concept of setting the optimum matrix factor is enabled further through the use of an image-analyzer device. This device provides complete separation of the levels of individual left, center, right, and surround (difference) components. This information can be used to drive a display, for assistance in manual adjustment, or it can be used to directly drive an automatic control circuit, for automatic optimization of the matrix factor in the imaging system.

DESCRIPTION OF THE PREFERRED EMBODIMENT

Figure 1:
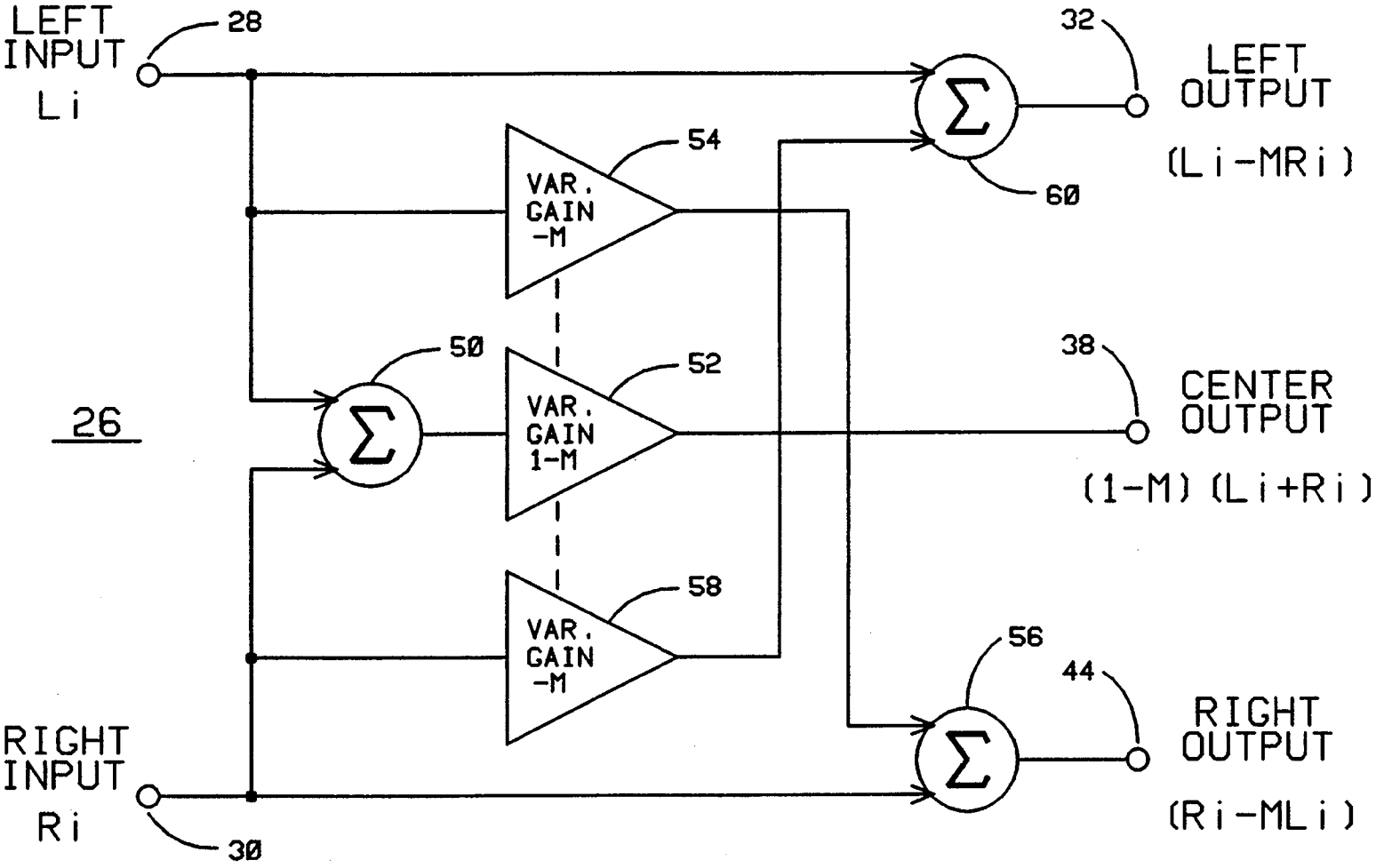
FIG. 1 is a block diagram of a linear-matrix audio-imaging network according to the invention.
Figure 2:
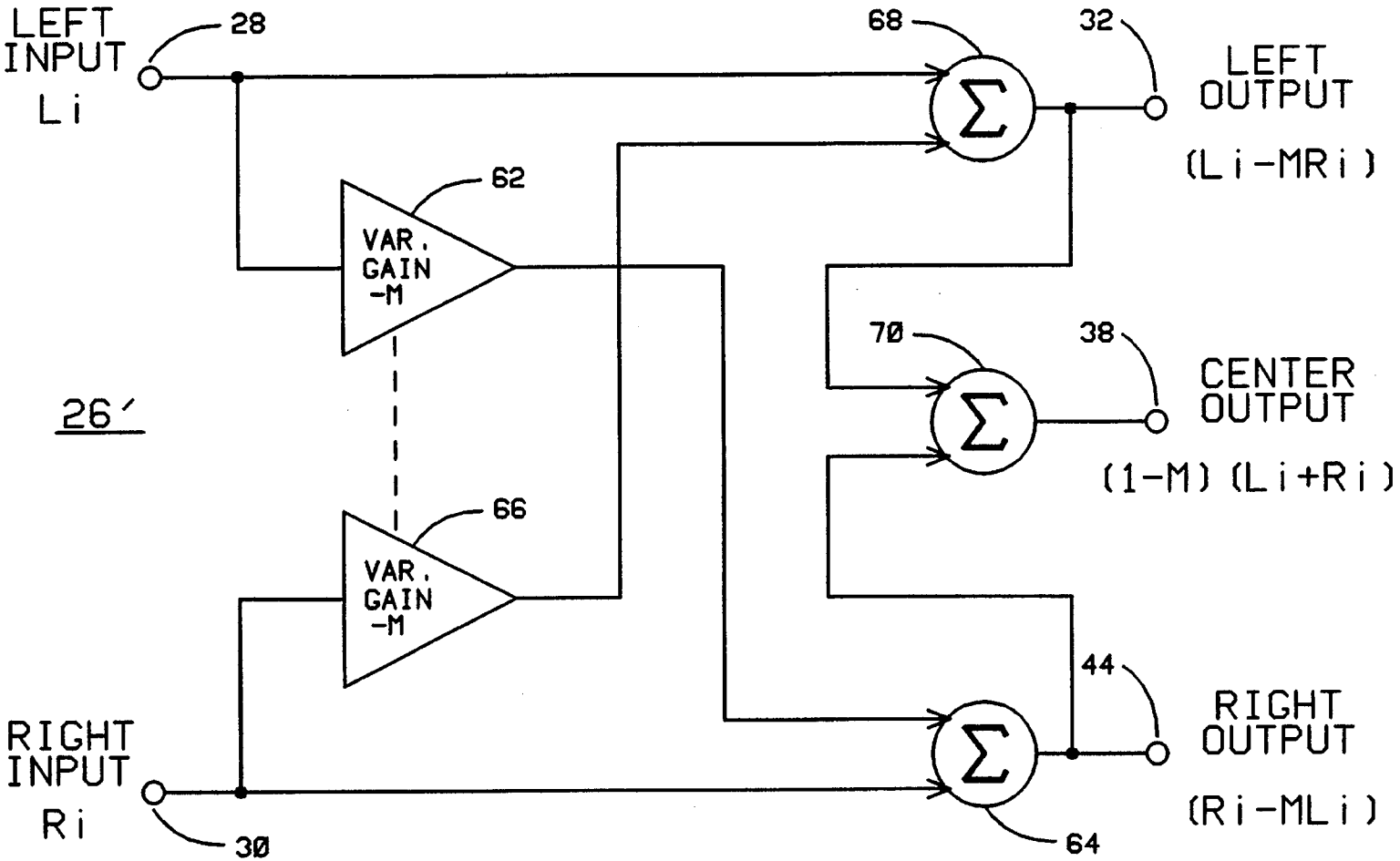
FIG. 2 is a block diagram of an alternative embodiment of a linear-matrix audio-imaging network according to the invention.
Figure 8:
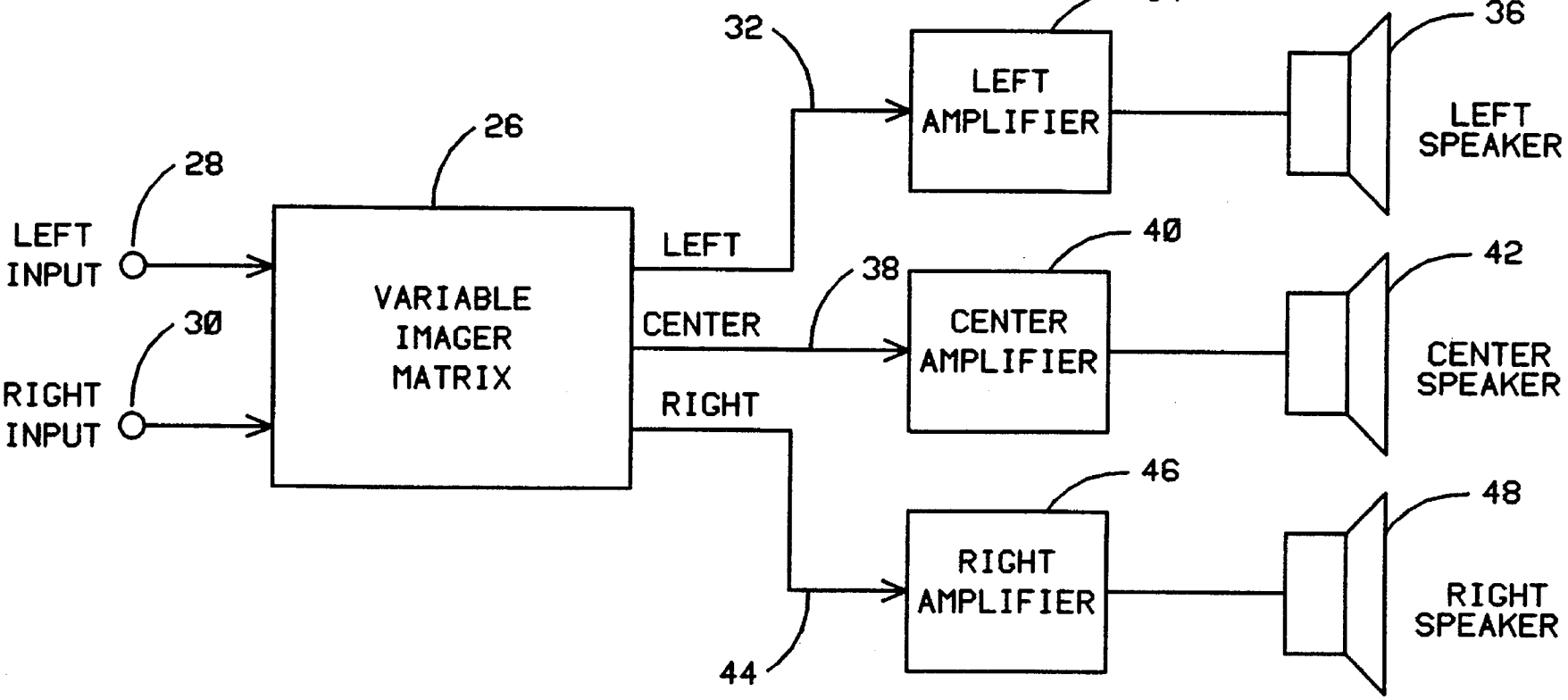
FIG. 8 is a block diagram of a linear-matrix audio-imaging system utilizing three amplifiers.

Referring now specifically to the drawings, and the illustrative embodiments depicted therein, a linear-matrix audio-imaging system 25 includes a variable imaging matrix 26 which receives a left channel input 28 and a right channel input 30, which may be signals developed by a conventional stereo system (FIGS. 1 and 8). Variable imaging matrix 26 produces a left output 32, which may be amplified by a left amplifier 34, to drive a left speaker 36. Matrix 26 additionally produces a center output 38, which may be amplified by a center amplifier 40, to drive a center speaker 42. Matrix 26 additionally produces a right output 44, which may be amplified by an amplifier 46, to drive a fight speaker 48. Left, center, and right outputs are derived from left and right inputs. The left output signal is created by adding to the left input signal, the right input signal multiplied by the factor —M where M is a matrix factor which can vary, in the preferred embodiment, from −1 through 0 to 1, and in typical use from about 0.45 to 0.7. The right output signal is created by adding to the fight input signal, the left input signal multiplied by the factor −M where the matrix factor M is equal to that used for the left channel, varying the same way, preferably from −1 through 0 to 1, and in typical use from about 0.45 to 0.7. The center signal is derived by summing the left and right input signals and multiplying them by a gain of 1−M or, alternatively, by summing the derived left and right output signals at unity gain. The derivation process is illustrated in FIG. 1, and an alternative version of the same process is illustrated in FIG. 2.

The generalized mathematical description is:

Lo=Li−M×Ri

Co=(1−M)×(Li+Ri)

Ro=Ri−M×Li or alternatively in matrix form:

$$[Lo\ Co\ Ro] = [Li\ Ri] \times \begin{bmatrix} 1 & 1-M & -M \\ -M & 1-M & 1 \end{bmatrix} = [Li - M \times Ri \quad (1-M) \times (Li + Ri)\ Ri - M \times Li]$$

where:

M=the variable matrix factor that may be set anywhere between −1 and +1 and is, typically, set between +0.45 and +0.7 for most programs Li=the left input signal Ri=the right input signal Lo=the left output signal Co=the center output signal Ro=the right output signal The matrix factor M, in theory, could be set at 0.5 to maximize the separation between the signals. However, in practice, the optimum value varies and is typically somewhat higher, such as around 0.55. This is to compensate for the way recordings are usually made for existing playback systems. Some recordings have less separation and may need a matrix factor of 0.65 or 0.7; others have excessive separation and, thus, need a lower factor such as 0.45. Most recordings are optimum near the center of that span of values, although it depends also on the speaker and listener locations in the playback system.

This variation of optimum matrix factor is partially the result of recordings being monitored with two speakers, in which case it is typical for center-panned signals to be higher than side-panned signals in level by 2 or 3 dB in a left-right sum. This compensates for the imperfect acoustic summing response of a two-speaker monitor arrangement. In the present imaging system, the center is created with an electrical sum, rather than an acoustic sum, which causes a relative increase in level of 3 dB or so. The correctly-set matrix factor will compensate for this. The variation of optimum matrix factor is also partially a result, in the playback system, of perceived level differences which occur when a side image, with an opposing inverted source, is compared with a center image, which includes three non-inverted sources.

Beyond the optimum range of adjustability of M, the full-range of adjustment is useful for system-balance calibration, signal verification, or special effects such as intentionally altering the program mix. For example, a matrix factor M set to a −1 will cause left output 32, center output 38, and right output 44 to produce a monophonic signal, which is the sum of the left and fight channels. A monaural output may be desirable for certain programs. Conversely, setting the matrix factor M to +1 causes the left output 32 to produce a signal that is a subtraction of the right channel from the left and the right output to produce a signal that is a subtraction of the left from the right. This is the signal that is utilized in conventional systems for "surround-sound imaging" which is utilized to produce an ambient acoustic signal. With the matrix factor M set at 1, the center output is 0. Because most vocals are imaged at the center, the 0 output eliminates most vocals from a program. This allows the use of the instrumentals in order to dub in a different vocal or the like. This control position allows listening to the difference component of the program signal for evaluation of stereo signal quality, listening to an alternative mix, or adjustment of program channel balance. The program channel levels can be accurately balanced by nulling the center-panned signals, such as vocals, while listening to the difference signal. However, for most normal listening experiences, the matrix factor will be established in its conventional range as set forth above.

Figure 6:
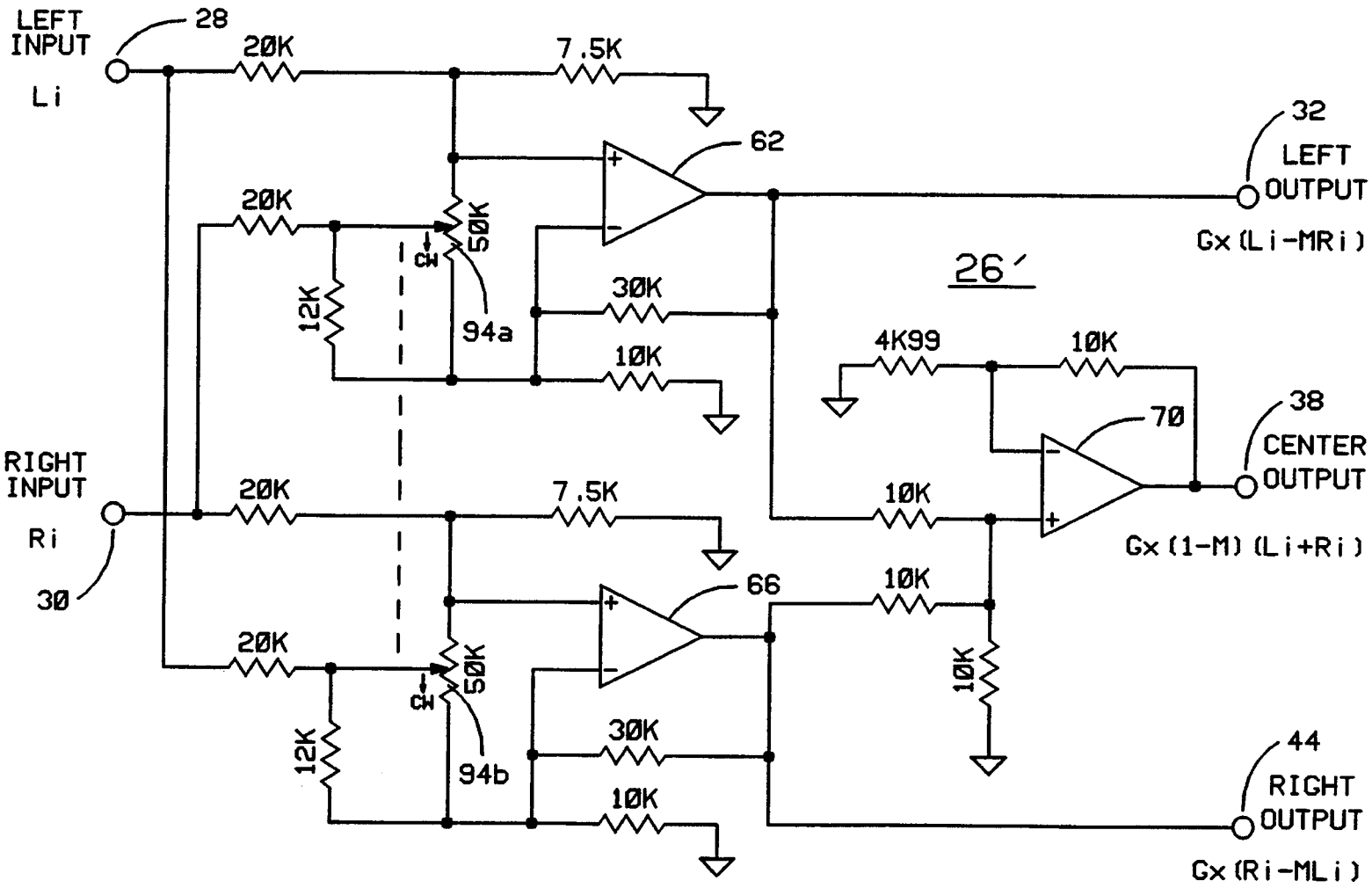
FIG. 6 is an electrical circuit diagram of a detailed embodiment of the audio-imaging network in FIG. 2.

With the control at intermediate positions, a fine adjustment is offered in the circuit of FIG. 6 for the matrix factor within the normal range of use, as shown here for the left output. The right output is symmetrically opposite.

| Control Position | Matrix Factor | Left Gain | Right Gain |
|---|---|---|---|
| Full Counter-clockwise | −1.00 | 0.86 | 0.86 |
| 20% | 0.17 | 1.14 | −0.17 |
| 40% | 0.42 | 1.23 | −0.52 |
| 50% | 0.50 | 1.26 | −0.63 |
| 60% | 0.56 | 1.29 | −0.72 |
| 80% | 0.69 | 1.35 | −0.93 |
| Full Clockwise | 1.00 | 1.50 | −1.50 |

The output gain of the circuit is designed to vary so that the resulting signal levels remain approximately constant. This, of course, depends on the program source material, but with typical stereo programs, the overall gain, represented by the values shown as Left Gain, are appropriate. At the monophonic extreme (counterclockwise position) the gain factor of 0.86 is appropriate to compensate for the typical resulting signal-level increase; at the difference-signal extreme, the gain of 1.50 is appropriate since the difference signal is usually weaker with most program sources. The mid-position gain of around 1.26 is appropriate to compensate for the reduction of signal level, which typically results from the matrix subtraction process.

An optional ambient audio, or "surround," output (not shown) can be derived using a signal equal to the difference between the left and right outputs. A practitioner of the art will be familiar with this concept in which the signal is generally used to drive speakers that are positioned behind or to the sides of the listener. With such an implementation, the surround speakers will be essentially off at the full-counterclockwise matrix control position. The surround speakers will be 6 dB higher in level than the sides with the matrix control at the full clockwise position. As the matrix control is adjusted for the program source, the surround output, once set at the correct relative level, will always be at the correct level for the program source. Hence, as the matrix control is used to balance the center with the sides, simultaneously the surround output will be correctly balanced with the rest of the system.

Imaging matrix 26 may be implemented utilizing an adding circuit 50 which combines the left input 28 with the fight input 30, which is applied to a variable gain amplifier 52 (FIG. 1). The output of variable gain amplifier 52 is the center output 38. The left input 28 is applied through a variable gain amplifier 54 to an adder circuit 56, which combines such output with right input 30 in order to provide a signal to right output 44. Likewise, right input 30 is applied to a variable gain amplifier 58 whose output is applied to an adder circuit 60 which combines such signal with the left input 28 to provide a signal to left output 32. The gain of variable gain amplifiers 52, 54, and 58 are variable by a common number M, which is a unitless number. Amplifiers 54 and 58 have a gain of-M and amplifier 52 has a gain of 1−M.

An alternative variable imaging matrix 26' includes a variable gain amplifier 62, which receives an input from left input 28 and produces an output that is added by an adder circuit 64 with fight input 30 to provide a signal to right output 44. A second variable gain amplifier 66 has its input connected with right input 30 and produces an output, which is added by an adder 68 with left input 28 to provide a signal to left output 32. The signals on left output 32 and right output 44 are added by an adder circuit 70 to produce center output 38. Variable gain amplifiers 62 and 66 have gains established by a common factor, namely both are set at –M. A comparison of FIGS. 1 and 2 indicates that variable image matrices 26 and 26' produce identical linear-matrix outputs.

Left speaker 36, center speaker 42, and fight speaker 48 are positioned in a listening area 72 in a direction facing the listener or listeners. An advantage of linear-matrix audio-imaging system 25 is that the image produced is less sensitive with respect to the positioning of the listener within listening area 72 than with conventional center speaker systems. This is because, irrespective of the position in the listening area, the inverted cross-mixing of the signals provided in stereo system 25 allows the listener to separate the right-side and left-side signals irrespective of location. Importantly, the frequency response to the listener is also enhanced. A common phenomenon experienced with listeners that are not positioned in the exact center of a listening area is known as "comb filtering" wherein deep frequency-response nulls in the signal are experienced at various locations within the room. Stereo system 25 significantly reduces such comb filtering because the direct signal is much less likely to be totally cancelled anywhere in the room.

Figure 3:
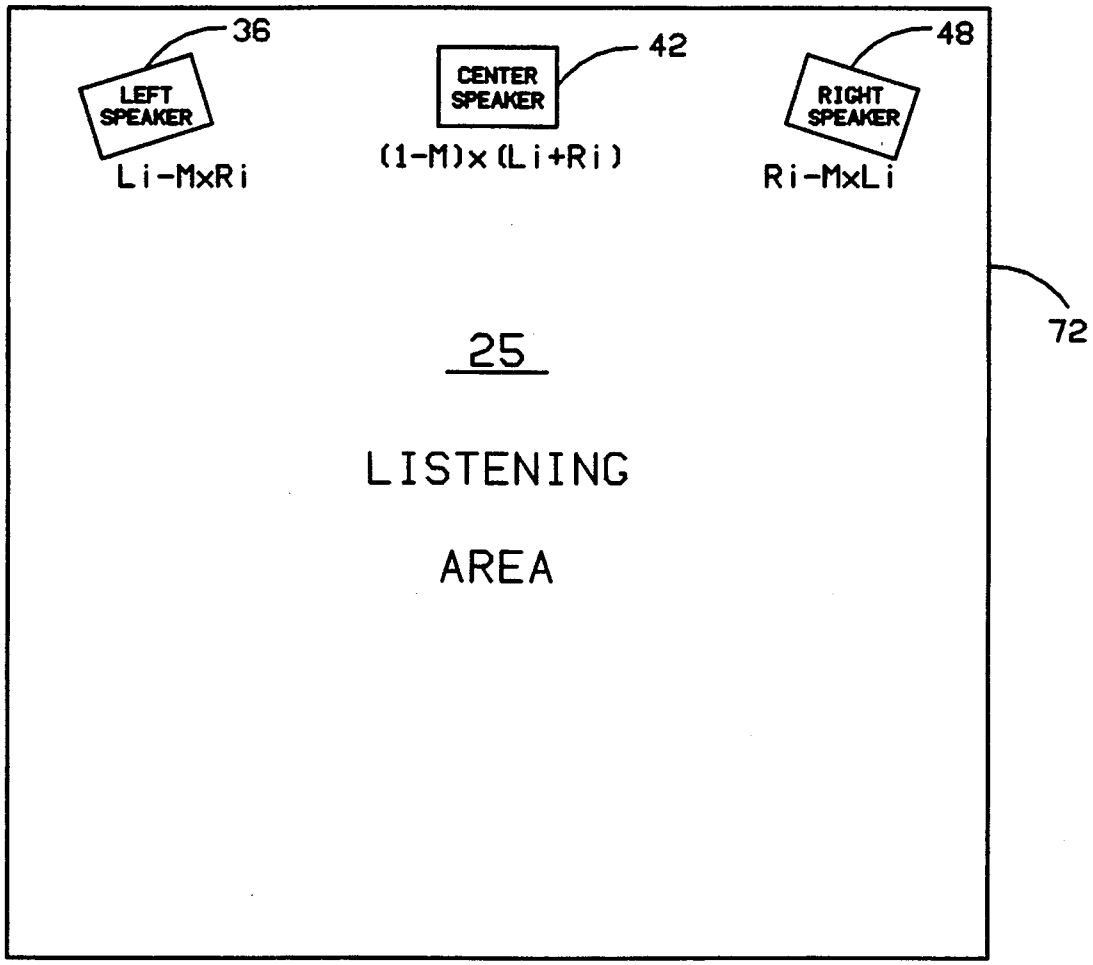
FIG. 3 is a plan view of a listening area illustrating a speaker placement and function according to the invention.

The electrical process thus described allows the theoretical-maximum six (6) dB of electrical separation between any two output channels. This amount of channel separation can be effectively and subjectively increased further using the principle of acoustic vector-sum imaging. In order for this to occur, speakers 36, 42, and 48 should be placed approximately in a linear array as shown in FIG. 3. This allows each speaker to work together with the other two speakers to provide additional image stabilization without unsymmetrical or excessive relative time delays. This arrangement also allows each speaker to radiate significantly and evenly to the entire listening area. With this condition, acoustic vector addition of any radiated wave-front will provide the necessary sound cues to the human auditory system to reinforce the perceived directional characteristics, in the same direction as the maximum amplitude relationship, but to a yet higher degree of accuracy and distinction, at mid and low frequencies, where acoustic vector addition is perceivable. This effectively reinforces the amplitude-determined image location, resulting in more-apparent channel separation, and more-distinctive localization.

Figure 4:
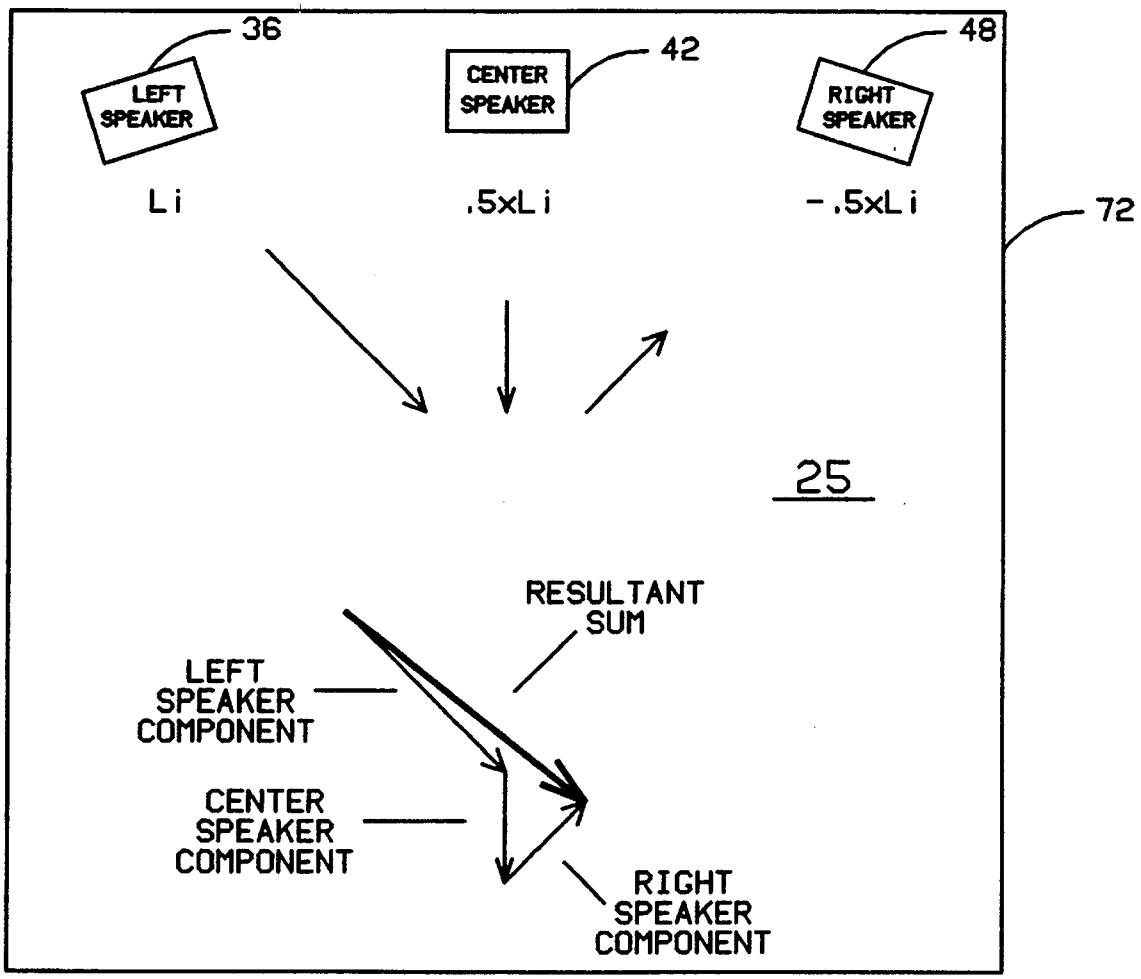
FIG. 4 is the same view as FIG. 3 incorporating a vector diagram illustrating operation of the system.

FIG. 4 illustrates the effect of acoustic-vector addition in a particular case where a single signal is panned fully to the left. In this example, a matrix factor M equal to 0.5 is used. The left speaker reproduces the left signal at full strength. The center speaker, with its attenuation factor of 0.5, pulls the apparent source location toward the center. The fight speaker, with its coefficient of –0.5, will acoustically "push" the apparent sound-source location back to the left again. This is illustrated in the diagram of FIG. 4 as a vector sum of three components. In this case, the resultant is theoretically pushed a bit further to the left than the left speaker. If a signal is panned fully to the right, then the system behaves the same way, only in the opposite direction.

In practice, the imperfection of acoustic summing, combined with time arrival differences and other psychoacoustic phenomena, results in a sum which is not necessarily exactly at the location of the left speaker. However, the adjustable matrix factor allows the extreme-side signal effects to be positioned as desired by the listener. The matrix factor effectively controls the width of the stereo image. In general, it is desirable in this system for the radiation or dispersion pattern of each speaker to be uniform and to cover the entire listening area. Good results can usually be achieved by aiming each speaker toward the center of the listening area. It is also desirable that the speakers radiate toward the walls as little as possible, because that creates reflections which obscure or degrade the stereo image.

For center-panned signals, the center output will always be 6 dB higher than the side outputs, regardless of the M value. And there will always be left and right pan positions, which also yield a level 6 dB higher in the corresponding output than in the center and opposite-side outputs. The location of these positions changes with M. The retention of this optimum separation level of varying positions while M is varied is an inherent advantage of this approach. For center-panned signals, the left and right speakers, being at equal levels, will create the conventional phantom center image. This phantom center will coincide with the actual center speaker, thus increasing the apparent separation well beyond the 6 dB of electrical separation. If a listener is way off center, then only the 6 dB of electrical separation will be evident, but that, in addition to the existence of a real center speaker, allows the center image location to be maintained. As M is varied, the relative level between the side speakers and center speaker will change. When the three speakers sound at the same level, the matrix factor and the channel separation will be optimized for that particular program source and playback system.

A preferred embodiment of variable-image matrix 26' is shown in FIG. 6. This circuit has several basic characteristics, which make it well suited for use in the implementation of the imaging system. The gain of amplifier 62 is established by a portion **94*a* of a potentiometer which is linked with a portion 94*b*, which establishes the gain of amplifier 66. In this manner, by rotating the shaft of potentiometer 94*a*, 94*b*, the matrix factor M may be applied in unison to both amplifiers 62, 66**. The matrix-factor control provides a full range of adjustment from –1 to 1.

Figure 7:
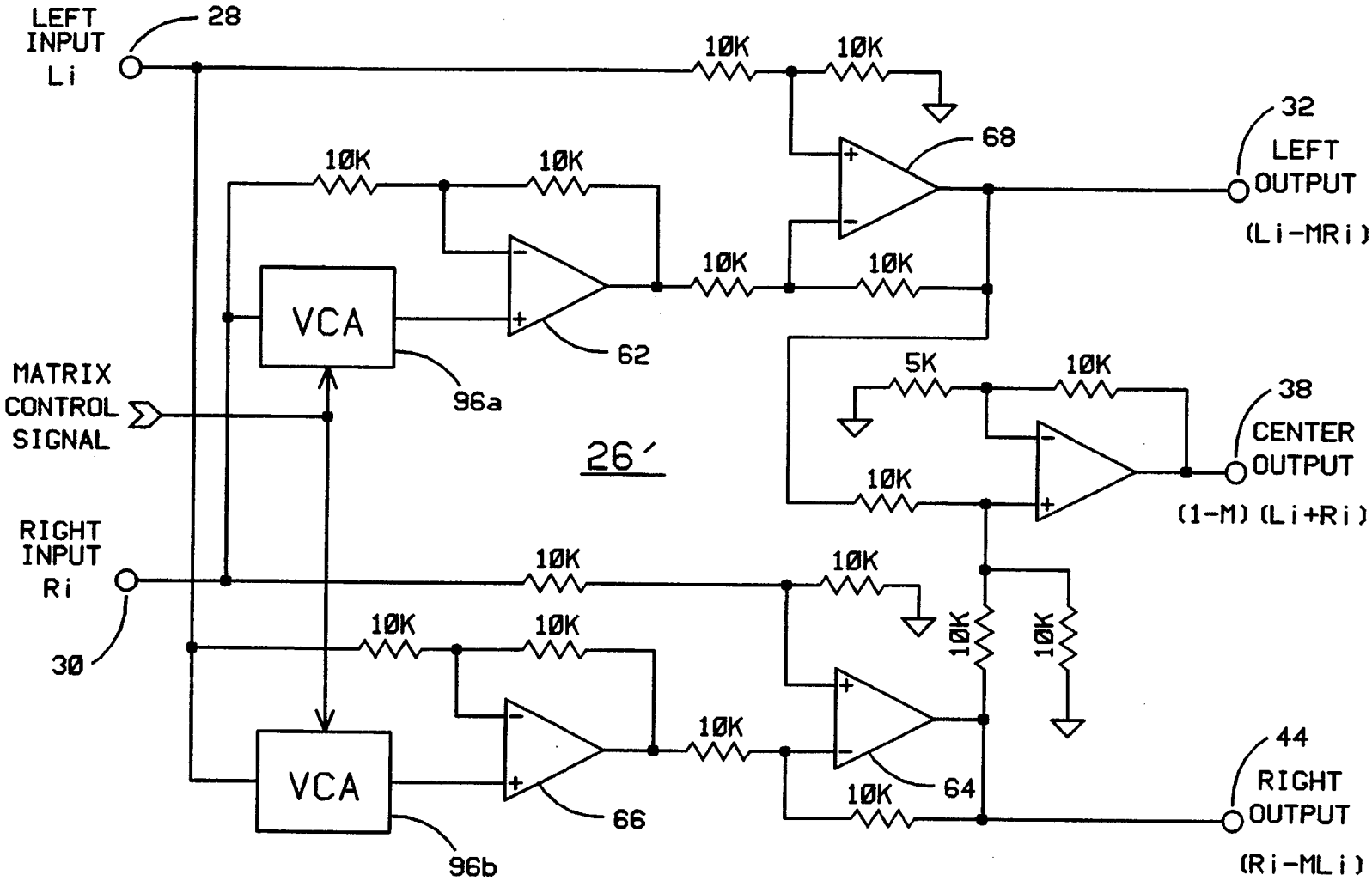
FIG. 7 is an electrical schematic diagram of an alternative detailed embodiment of the audio-imaging network in FIG. 2.

FIG. 7 shows an implementation of imaging matrix 26' when re,note control or computer control is needed. A voltage-controlled amplifier **96*a* is connected with the non-inverting input of amplifier 62. Likewise, a voltage-controlled amplifier 96*b* is connected with the non-inverting input of amplifier 66. VCAs 96*a*, 96*b*, which can be any gain-control elements such as DCAs, control the matrix factor. In this circuit if the VCA gain is unity, the matrix factor is 1 (full negative cross mixing; difference outputs). If the VCA gain is 0.825 (–1.67 dB), the matrix factor is 0.65, which is near the top of the optimum range. If the VCA gain is 0.75 (–2.5 dB), the matrix factor is 0.50, which is near the bottom of the optimum range. If the VCA gain is 0.5 (–6 dB), the matrix factor is 0 (no cross mixing). If the VCA is off, the matrix factor is –1 (monophonic output). A more direct approach, bypassing amplifiers 62, 66, may be simpler, although it would not allow the full range of matrix-factor control-positive cross-mixing would not be possible. Such an implementation would use a pair of VCAs directly for the variable gain (–M) blocks 62, 66 in FIG. 2**. This may be more desirable when positive cross mixing (negative matrix factor) is not needed.

Figure 9:
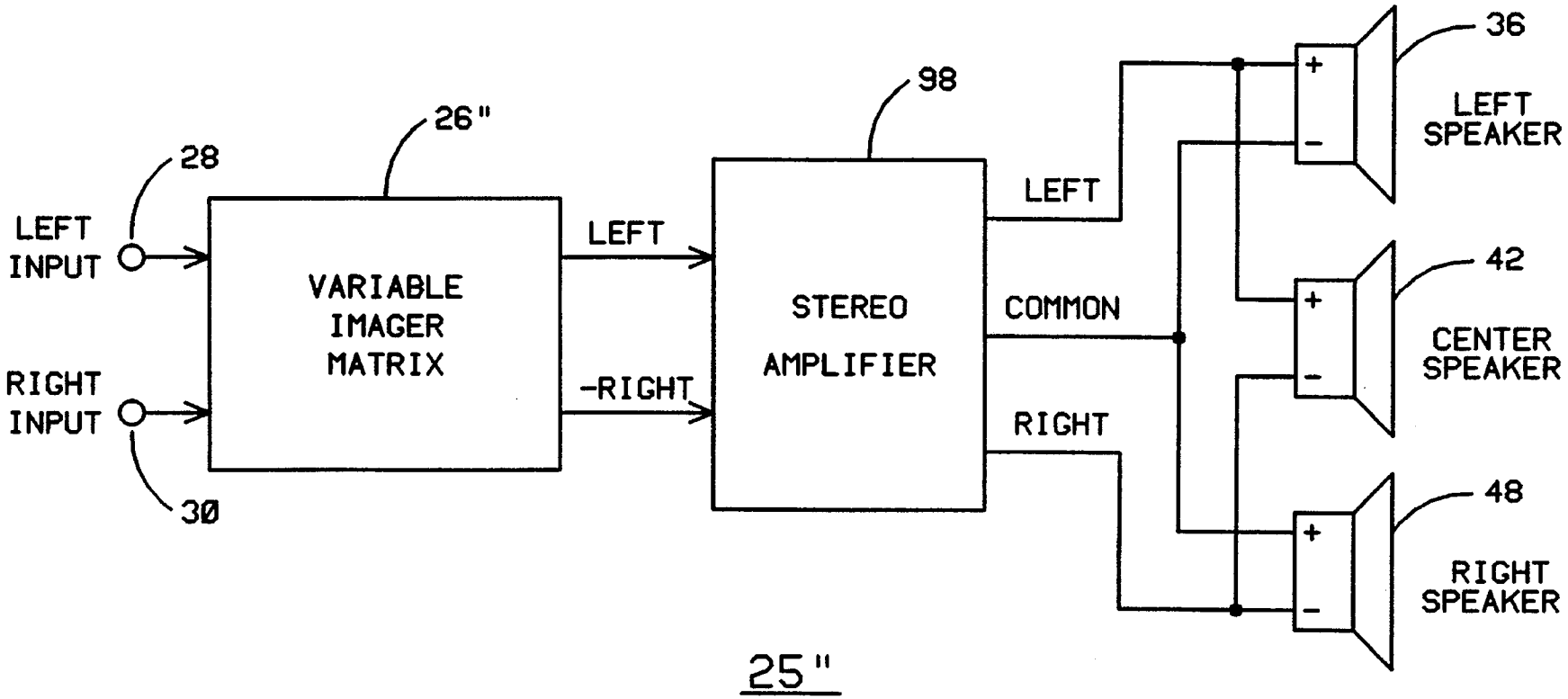
FIG. 9 is a block diagram of a linear-matrix audio-imaging system utilizing a single dual-channel stereo amplifier.

FIG. 9 shows a linear-matrix audio-imaging system 25" in which a variable imaging matrix 26" is used with a standard stereo amplifier 98 to drive all three speakers 36, 42, and 48. In this implementation, the right output of the variable matrix is inverted. This can be accomplished with a standard inverting amplifier circuit, or by using a differential-input power amplifier with the input connection reversed in polarity. Likewise, the right speaker connection to the amplifier is inverted so that correct fight-channel polarity is restored. The center speaker is bridged across the amplifier, which yields the correct left-plus-right drive signal. This implementation is especially useful for cost-effective or retrofit applications. It works extremely well when the speaker placement can be optimized for symmetry and correct relative levels. The center speaker will then always be at the correct level. It should be noted that the two amplifier channels must have a common return connection, and the amplifier may see a load impedance as low as one-third the impedance of an individual speaker.

Figure 11:
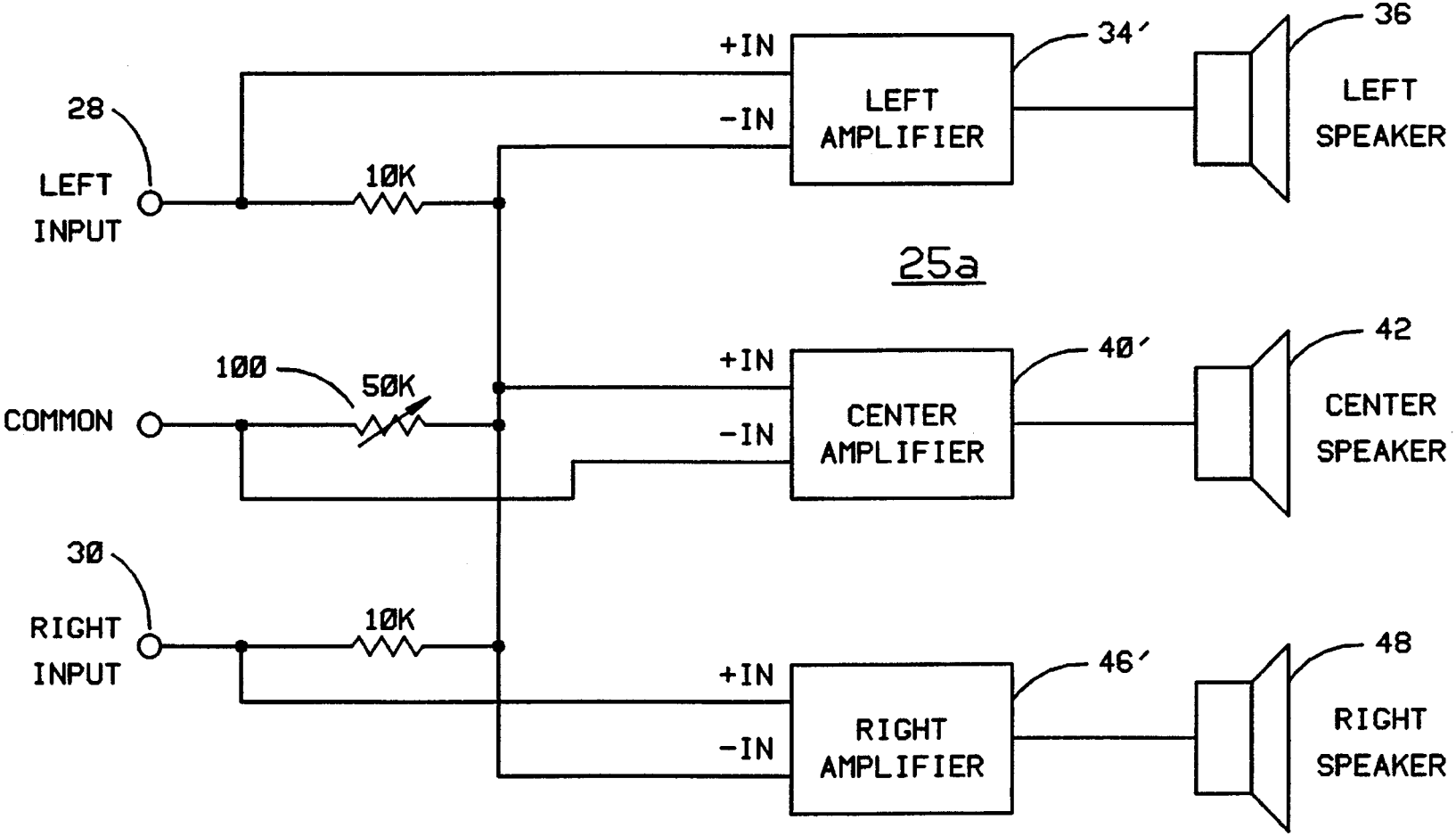
FIG. 11 is a block diagram of an alternative embodiment of a linear-matrix audio-imaging system according to the invention.

FIG. 11 illustrates a linear-matrix audio-imaging system 25*a*, which utilizes a unique connection of a line-level passive device, such as a variable resistor 100, to provide a variable imaging matrix. This approach requires individual power amplifier stages 34', 40', and 46' with differential inputs. Imaging system 25*a* is not optimal in that not only is the control range limited, but the constant-sum feature of the center output is not precise. However, it can be made to work over a limited adjustment range and can provide optimum operation in fixed-matrix applications where the matrix factor and each amplifier gain can be correctly set and left at the calibrated setting.

Figure 12:
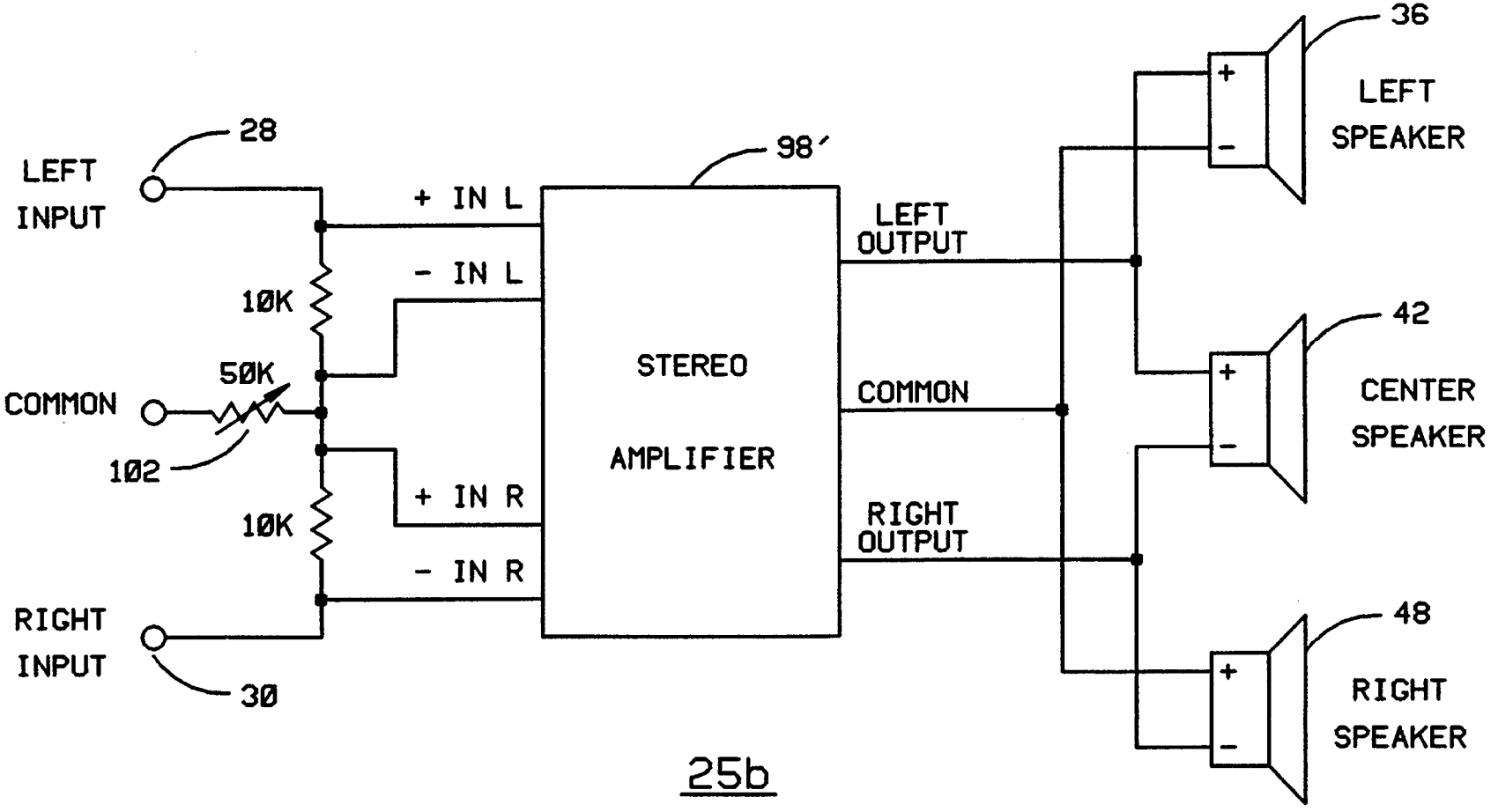
FIG. 12 is a block diagram of another embodiment of a linear-matrix audio-imaging system according to the invention.

FIG. 12 shows a linear-matrix audio-imaging system 25*b* which utilizes a line-level passive network 102 to provide a variable imaging matrix. System 25*b* utilizes a two-channel stereo power amplifier 98'. Imaging system 25*b* also has a limited control range. However, it does preserve the constant-sum feature of the variable imaging matrix and, thus, can provide the correct matrix outputs and levels throughout a selectable control range. In this arrangement, it is important to ensure that the passive matrix circuit is not asymmetrically loaded by the power amplifier inputs. The amplifier's differential inputs must have equal input impedance at the positive and negative input connections to avoid unsymmetrical loading and resulting matrix errors.

Figure 13:
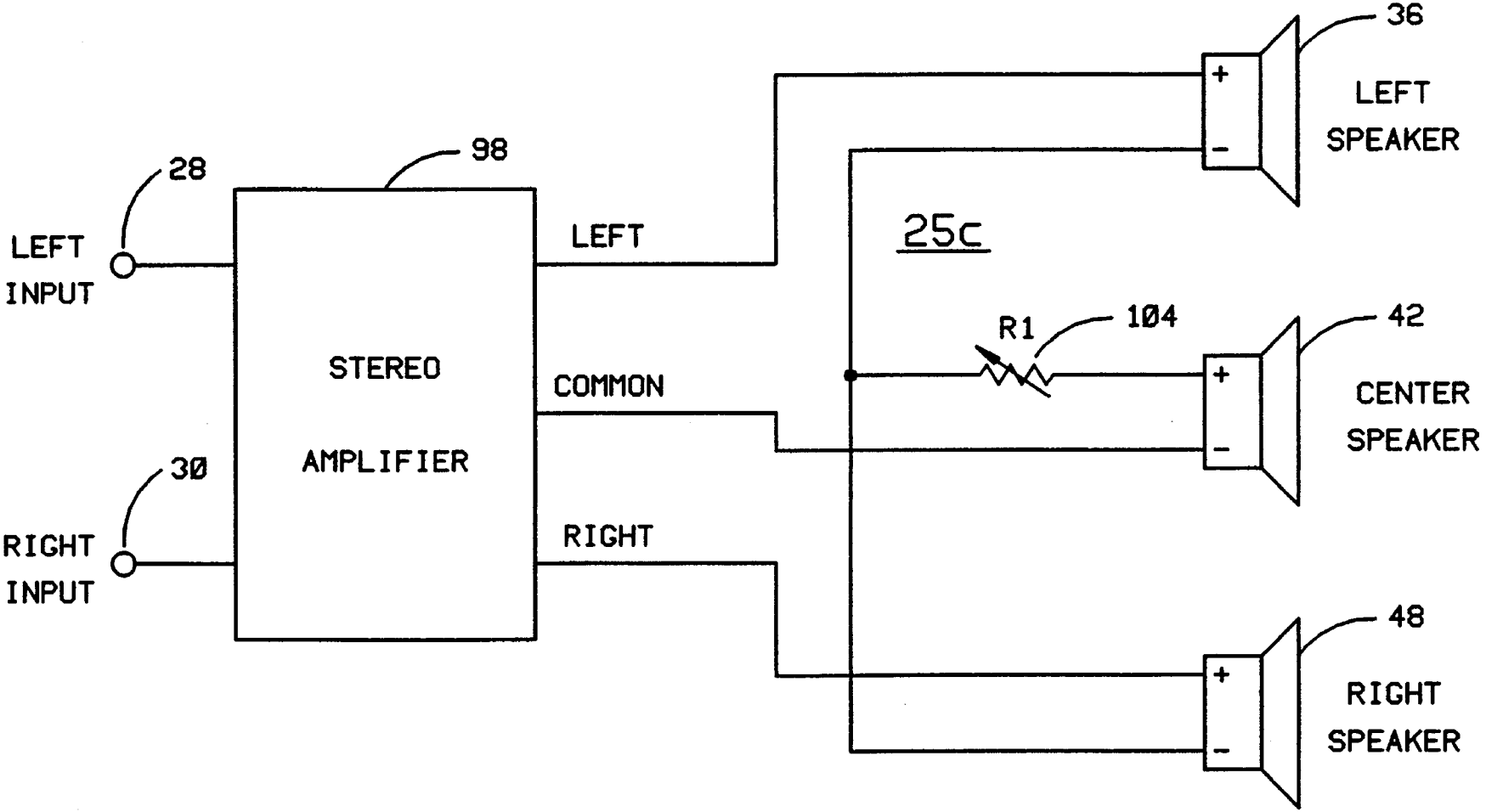
FIG. 13 is a block diagram of yet a further alternative embodiment of a linear-matrix audio-imaging system according to the invention.

FIG. 13 shows a linear-matrix audio-imaging system 25*c*, which includes a speaker-level variable-image matrix. A wye connection of speakers 36, 42, and 48 requires only a resistor 104 to provide the approximately correct relative signal coefficients. However, imaging system 25*c* is not optimal in that the speaker impedance and, hence, the matrix factor varies with frequency and is, therefore, only approximately correct. At certain frequencies, the speaker impedance typically rises, which may cause the matrix factor to vary. Also, imaging system 25*c* is lossy due to the presence of a resistor in the speaker leads and presents a higher total impedance to the amplifier resulting in less output power. Nevertheless, this implementation works subjectively fairly well, especially in relatively low-power systems. However, the control range is limited, and a control or fixed resistor with appropriately high power dissipation capability is needed.

The required resistance value will be:

$$R1=Z\times(2M-1)/(1-M)$$

where:

R1=the series resistor

Z=the nominal speaker impedance magnitude

M=the desired matrix factor

For typical 6-ohm or 8-ohm speakers, a resistance value of one or two ohms can give satisfactory results. Hence, a variable resistor with a maximum resistance of ten ohms offers a reasonable control range.

Figure 14:
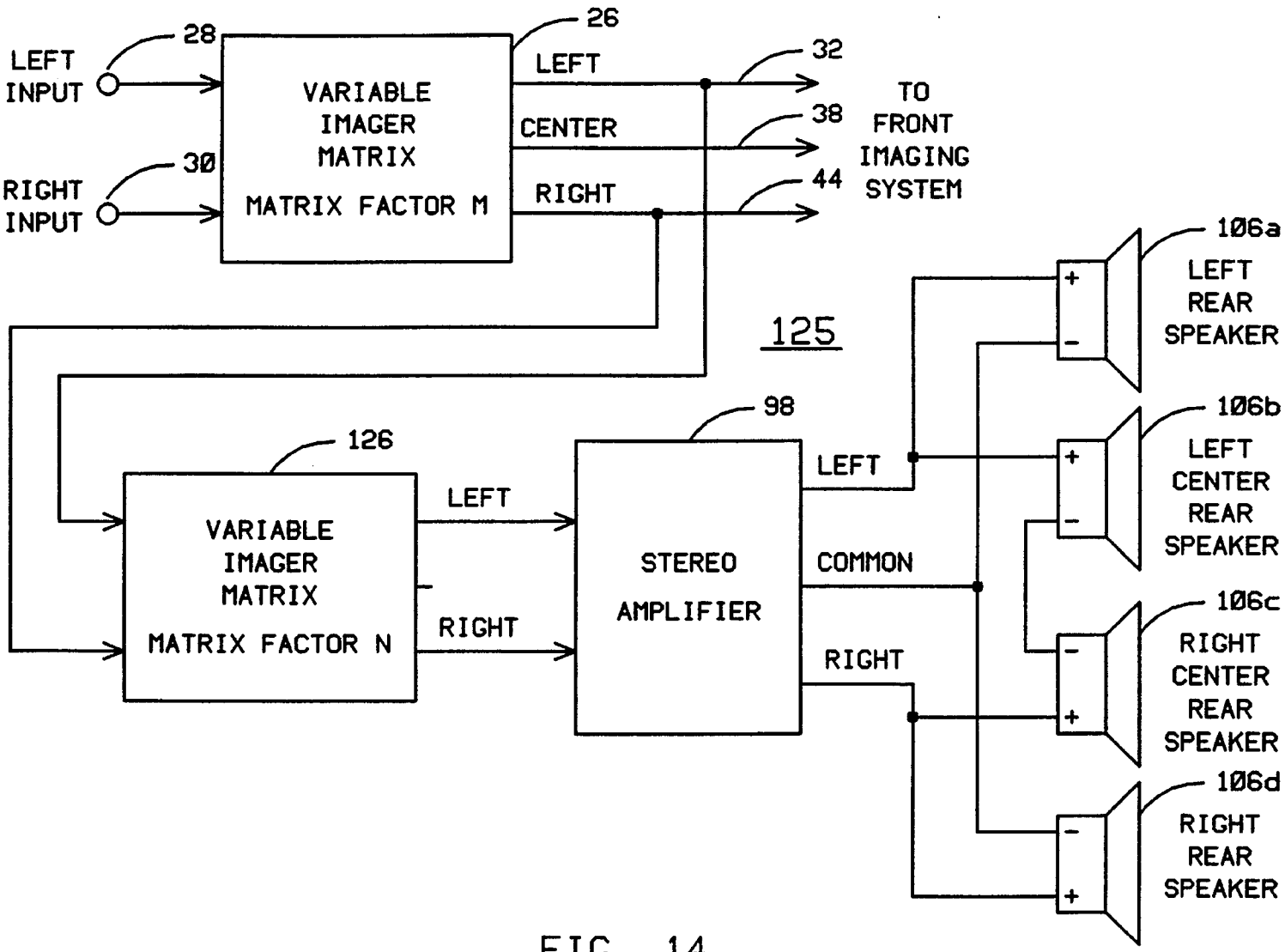
FIG. 14 is a block diagram of a linear-matrix audio-imaging system, including a rear surround audio-image capability.

FIG. 14 shows a linear-matrix audio-imaging system 125, which combines a variable imaging matrix 26 to produce outputs for driving the outputs of the front-imaging speakers (not shown). A variable imaging matrix 126 is connected with the left and right outputs of imaging matrix 26 to yield appropriate signals for an ambient or surround-imaging array of speakers 106*a*–106*d* centered on the stereo difference signal. While this latter function is based in part on the well-known difference-signal surround-channel derivation process, the use of imaging matrix 126 allows the surround system to offer a degree of stereophonic operation rather than the conventional monophonic multi-speaker surround process. Surround or ambient sounds can be weighted to the left or right side of the room. The matrix factor N for imaging matrix 126 may be set at approximately 0.2, which provides about 2.5 dB of left-right separation in the surround array for stereo-surround effects. This separation is sufficient to provide a side-to-side weighting of surround signals. This can greatly enhance the directional effect of front-image sounds, which are panned strongly to one side of the front. Audio-imaging system 125 allows the associated ambience related to the front image to be intentionally panned in surround mode to the same or opposite side of the surround system.

Figure 15:
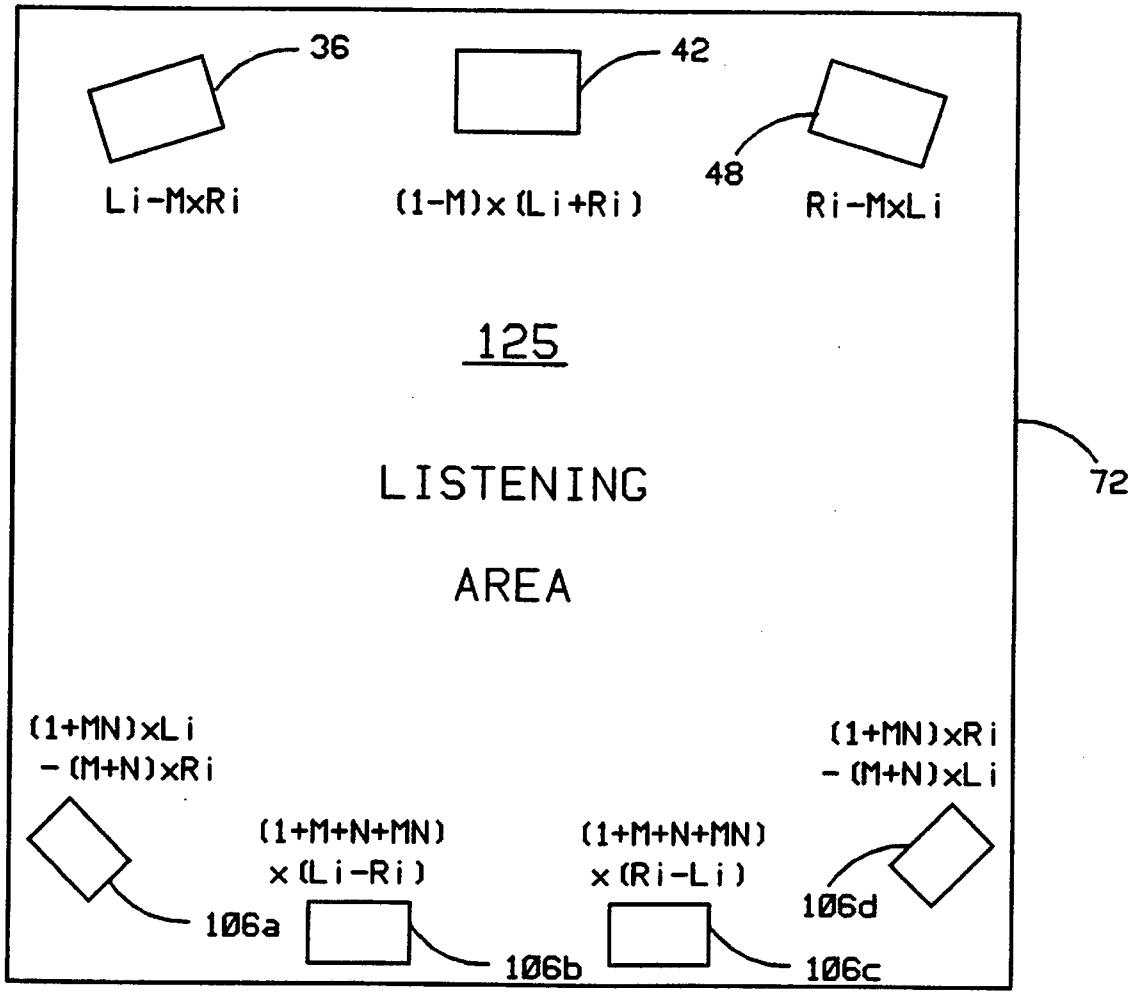
FIG. 15 is a plan view of a listening area illustrating a speaker placement for the system in FIG. 14.

The center-rear speakers 106*b* and 106*c* contain the usual straight difference signal and will dominate with monophonic (center-inverted) surround sounds. Two speakers, wired so that they are polarity-inverted with respect to each other, are needed for this purpose to avoid asymmetry due to a polarity preference in the transducers. Also, when wired in series, they provide the correct attenuation level to balance with the left and right surround speakers 106*a* and 106*d* when all four are driven from a single stereo amplifier. When the second-imager-matrix factor N is adjusted, the separation between the left and right surround speakers and the separation from the front-imaging speakers can be set at optimum levels. Once the second matrix factor N is preset, the front-imaging matrix factor M can be used to adjust the overall system balance with various program material, and the correct preset surround separation and level will always be maintained. FIG. 15 shows a listening area 72 including a typical recommended speaker placement for linear-matrix audio-imaging system 125 including a stereo-surround system used with the front-imaging system.

Figure 16:
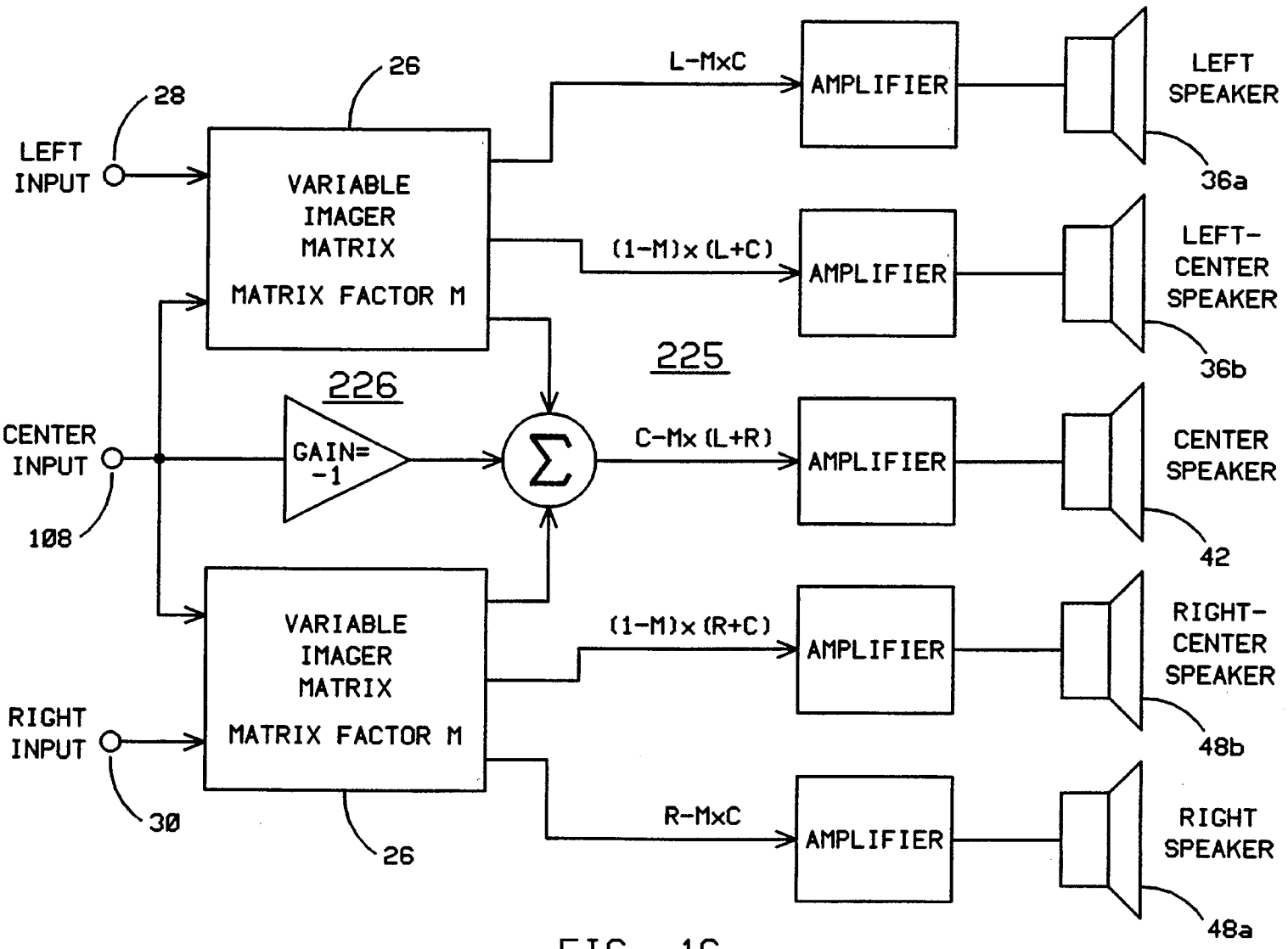
FIG. 16 is a block diagram of a linear-matrix audio-imaging system operable from a three-source-channel input and having a five-speaker imaging output.
Figure 17:
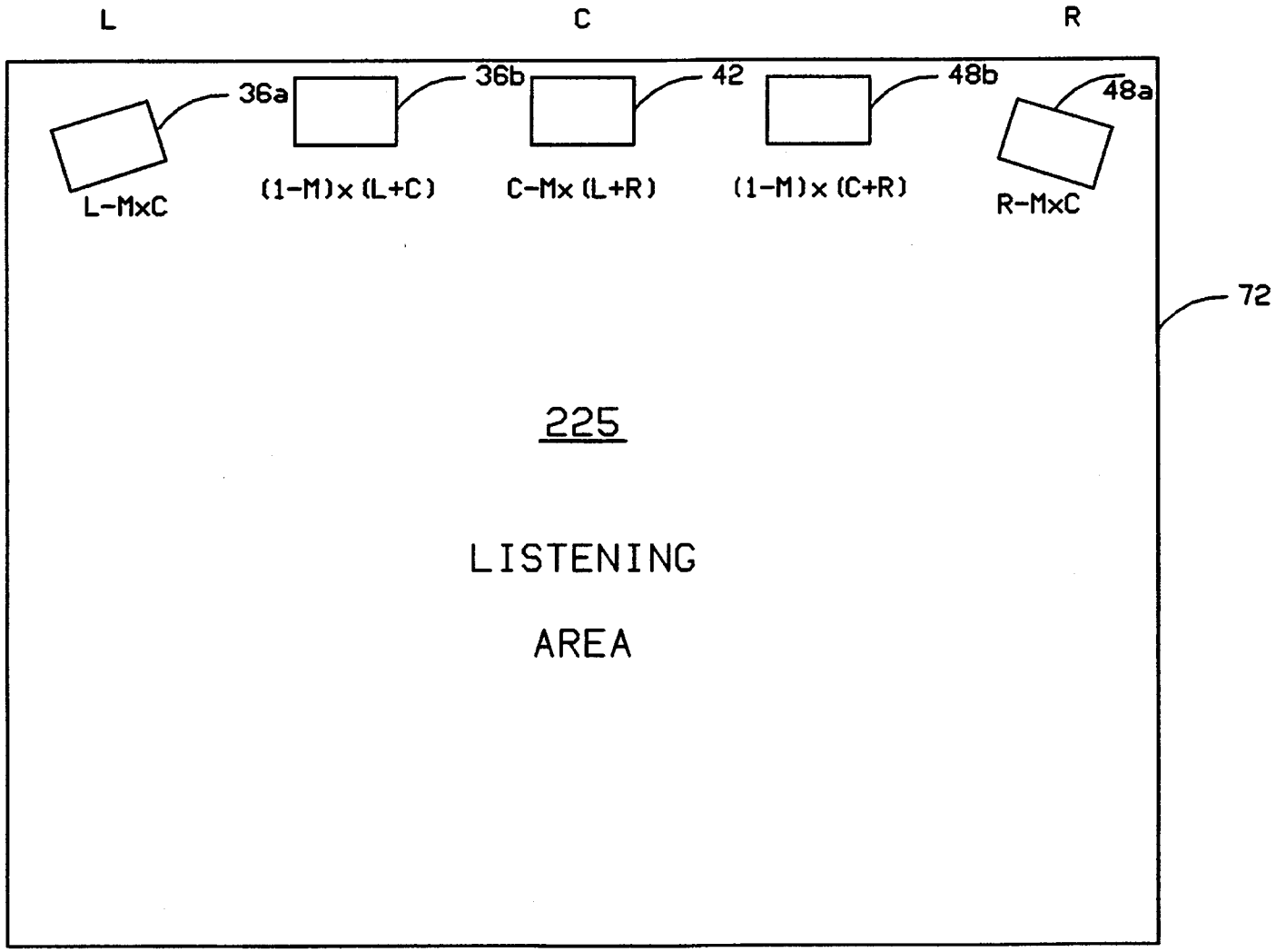
FIG. 17 is a plan view of a listening area illustrating a speaker placement for the system in FIG. 16.

FIG. 16 shows a linear-matrix audio-imaging system 225, which utilizes a variable imaging matrix 226 to drive a five-speaker setup with three discrete input channels 28, 30, and 108. A typical application could be a sound system in a movie theater where existing systems include three program channels to drive left, center, and right speakers. The imaging matrix 226 is in the form of a pair of variable image matrices 26 to provide improved imaging between left speaker 36*a* and center speaker 42 and between right speaker 48*a* and center speaker 42 with two additional speakers 36*b* and 48*b*. The transfer equations are shown in FIG. 16. The control matrix factor M should be ganged, or preset, for optimum adjustment. Note that the center speaker 42 includes the cross-mix component from both sides. FIG. 17 shows a listening area 72, including a recommended speaker placement for linear-matrix audio-imaging system 225.

Figure 18:
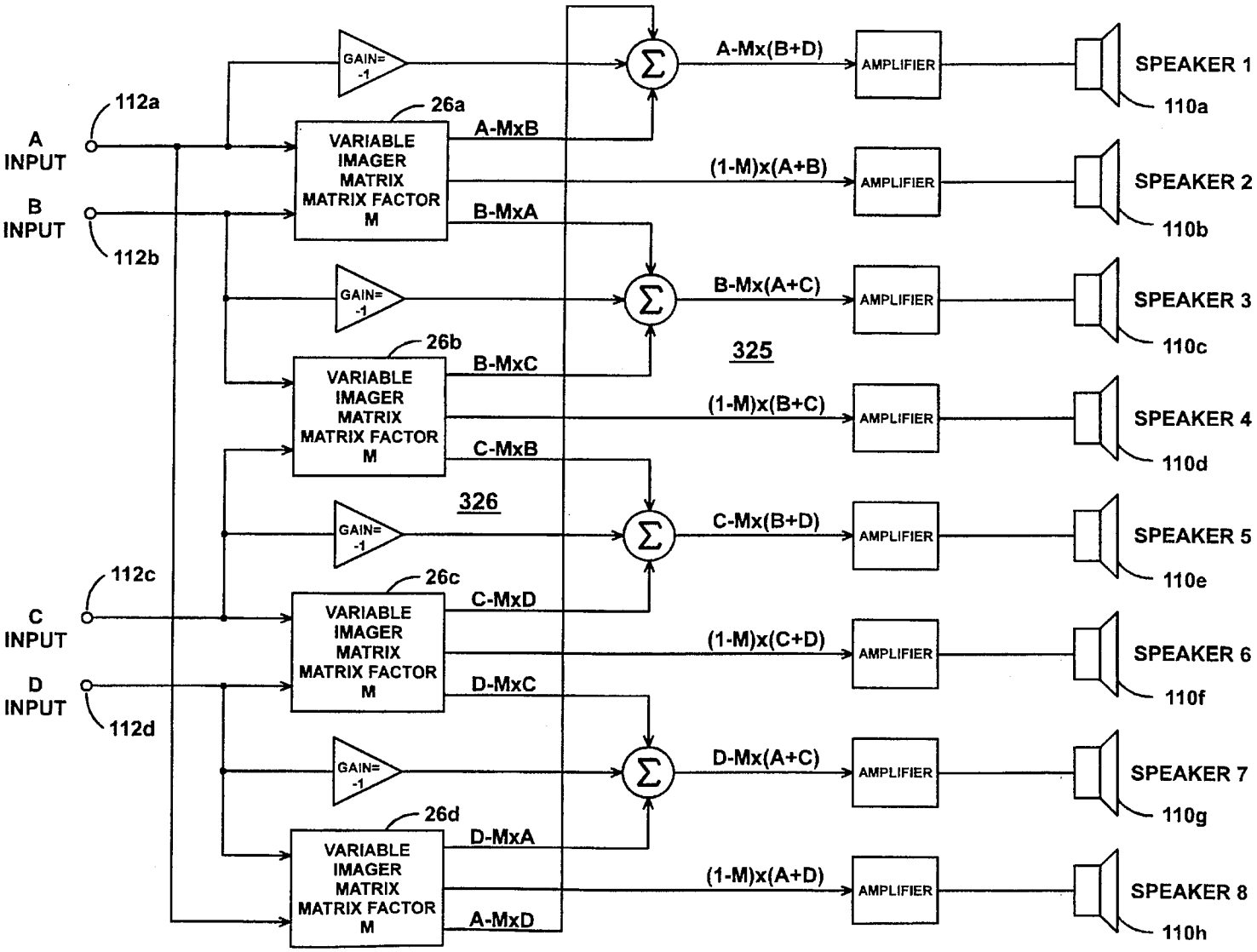
FIG. 18 is a block diagram of a linear-matrix audio-imaging system operable with a four-source-channel input and having an eight-speaker imaging output.
Figure 19:
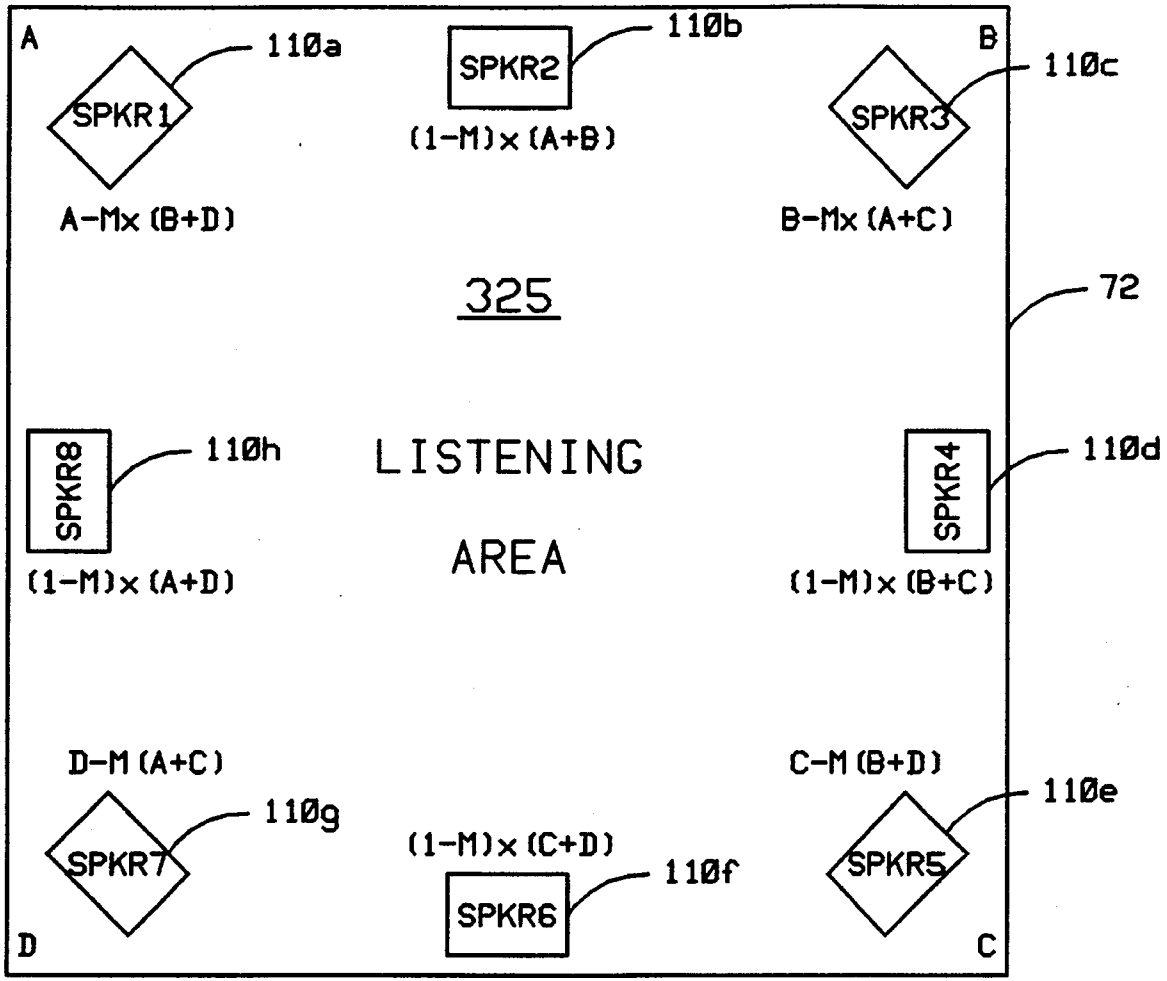
FIG. 19 is a plan view of a listening area illustrating a speaker placement for the system in FIG. 18.

FIG. 18 shows a linear-matrix audio-imaging system 325, which utilizes an imaging matrix 326 to drive eight speakers 110*a*–110*h* with four discrete input channels 112*a*–112*d*. A typical application for audio-imaging system 325 is a playback or monitor system for four-channel discrete surround-sound recordings. The input channels are labelled A, B, C, and D and correspond to the original four channels and image-pan locations. Four imaging matrices 26*a*–26*d* provide improved imaging between each pair of corner speakers using four additional speakers centered in between each pair of original speakers. This system is capable of providing a highly accurate stereo image in any direction, as heard from a large listening area in the interior of the room. The transfer equations are shown in FIG. 18. The matrix-factor controls should be ganged or preset for optimum adjustment. Note that each corner-speaker output includes the cross-mix component from both opposite sides, which are the adjacent corners. FIG. 19 shows a listening area 72, including a recommended speaker placement for linear-matrix audio-imaging system 325.

Figure 20:
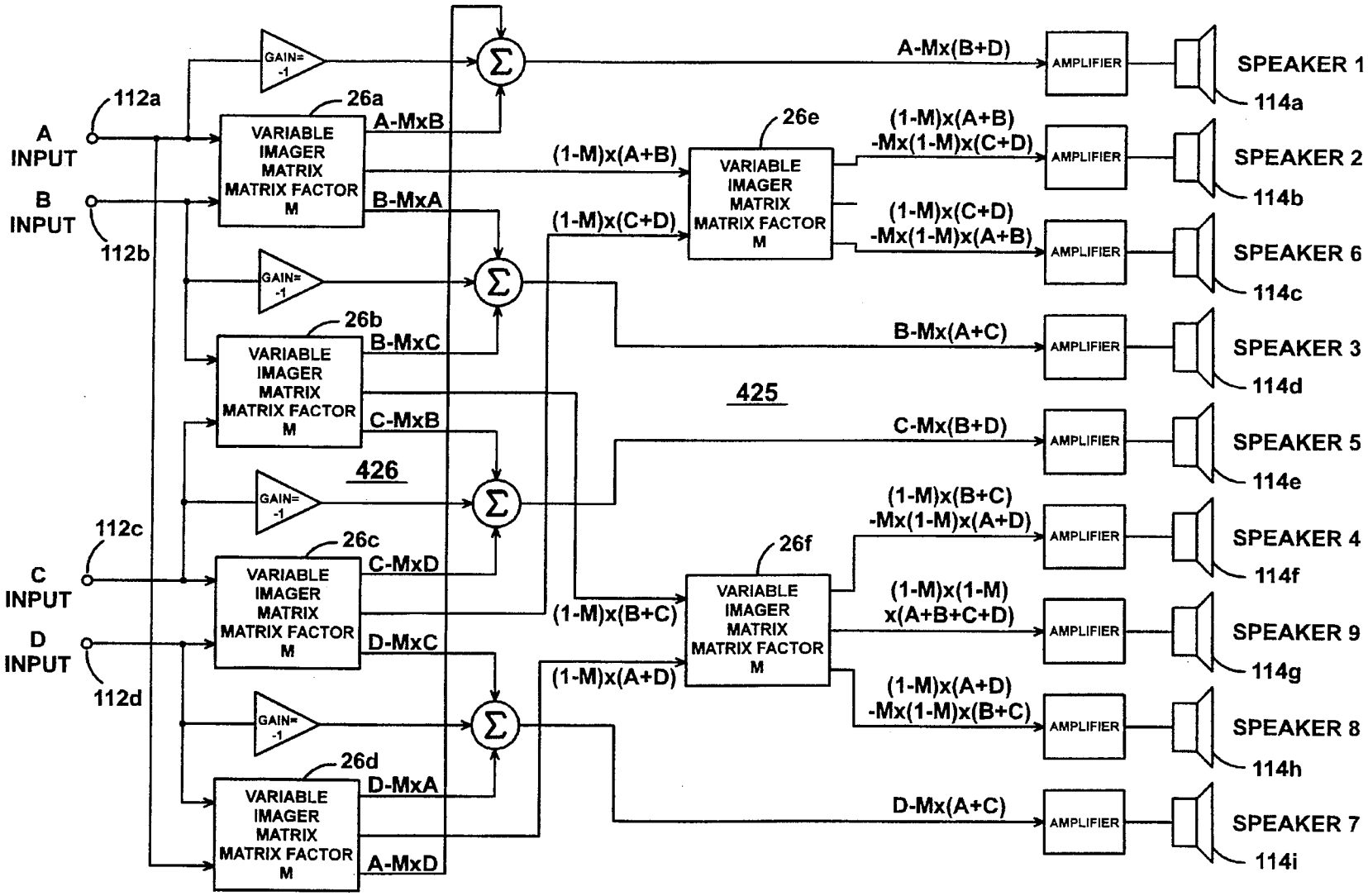
FIG. 20 is a block diagram of a linear-matrix audio-imaging system operable from a four-source channel input and having a nine-speaker front-image output.
Figure 21:
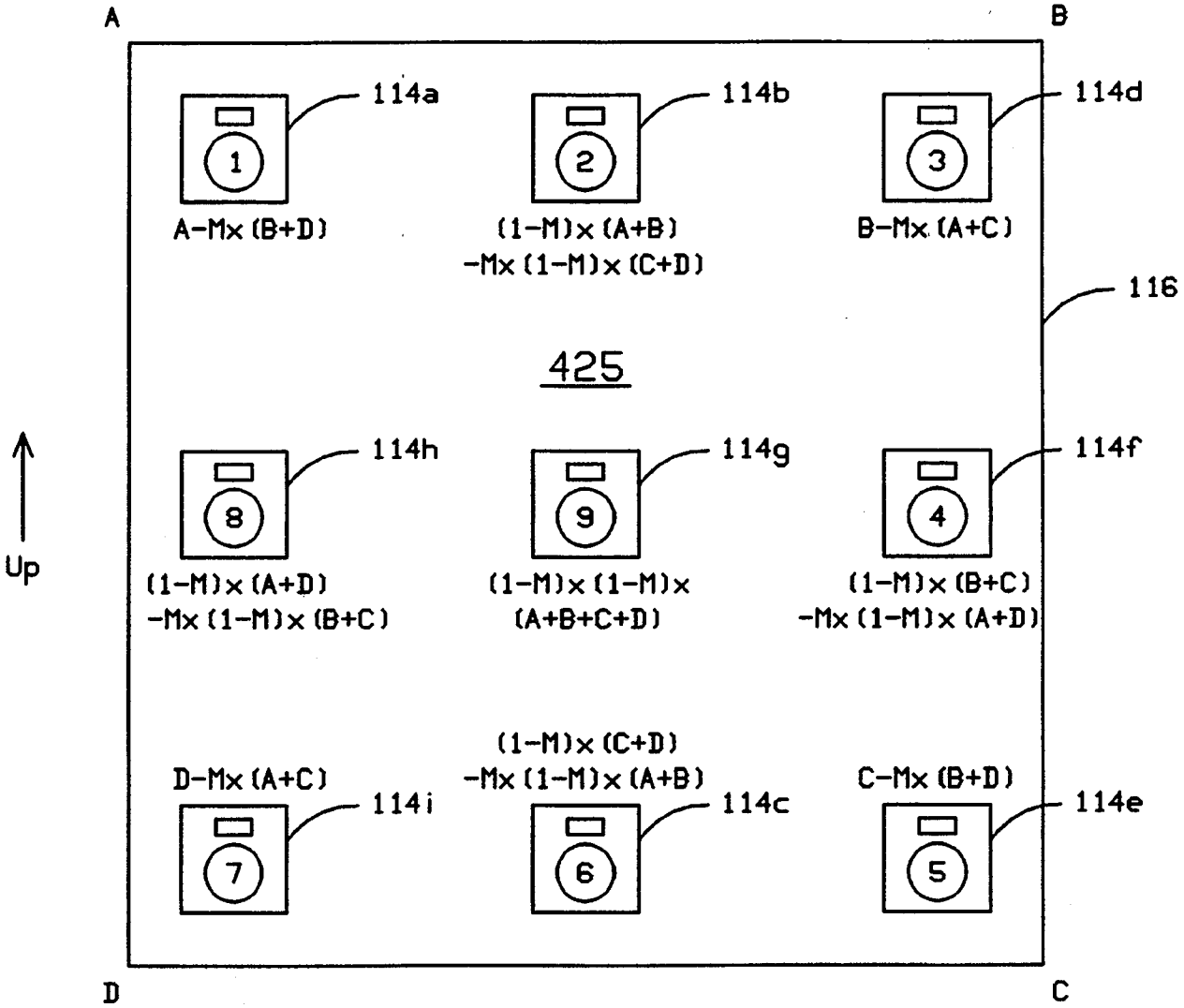
FIG. 21 is an elevation of a vertical wall illustrating a speaker placement for the system in FIG. 20.

FIG. 20 shows a linear-matrix audio-imaging system 425, which utilizes an imaging matrix 426 to drive nine speakers 114*a*–114*i* arranged about a vertical wall with four discrete input channels 112*a*–112*d*. A typical application for system 428 is a music or movie theater system in which both lateral and height information is to be reproduced and correctly imaged. The four input channels are labelled A, B, C, and D and correspond to the upper-left, upper-right, lower-right, and lower-left image-pan locations, respectively. FIG. 21 shows a wall 116 about which speakers 114*a*–114*i* are arranged in a 3×3 matrix.

Six imager matrices 26*a*–26*f* provide improved imaging between each pair of corner speakers and each opposite pair of side speakers. The four even-numbered speakers include not only the center-image signal component for the triple of which it is a center speaker, but also the appropriate side-image signal component for its triple which includes the center speaker 114*g*. Hence, a five-speaker interior imaging array is synthesized from the four corner-speaker channels. The transfer equations for audio-imaging system 425 are shown in the diagram in FIG. 20. The matrix-factor controls should be ganged or preset for optimum adjustment. In general, the amplifier gains should be equal; although for large walls, the upper channels should be increased slightly to compensate for their further distance from the listener.

Other combinations are possible, such as a combination of systems 225 and 425, illustrated respectively in FIGS. 16 and 20, in which a triangular wall system is made which uses a three-channel source to provide width and height imaging using six or seven speakers. Various other shapes and input-output configurations may be provided according to the invention, using the variable imaging matrix in multiplicity as the basic two-to-three derivation process for each pair of program source channels.

Figure 5:
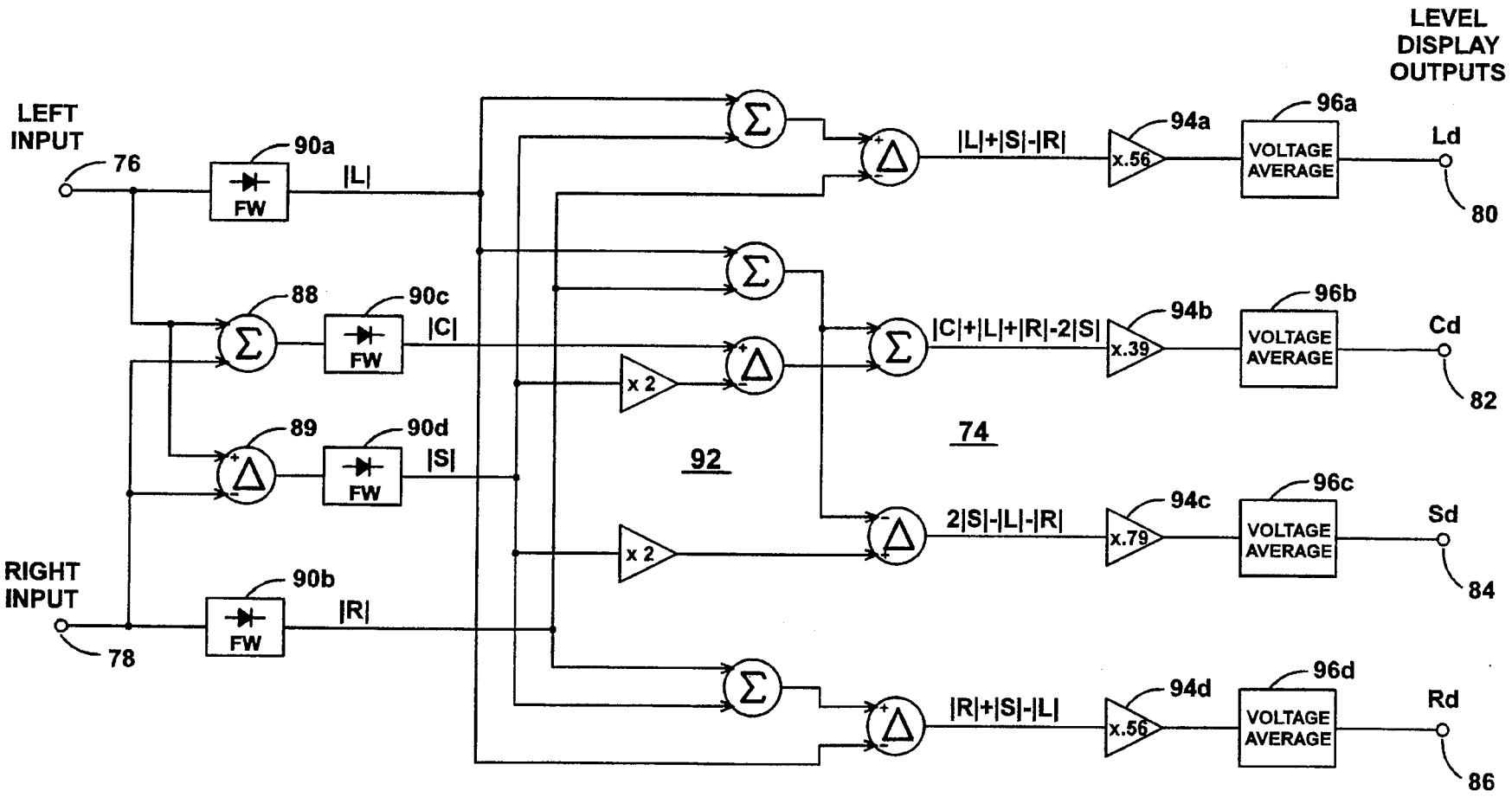
FIG. 5 is a block diagram of an audio-image analyzer according to the invention.
Figure 10:
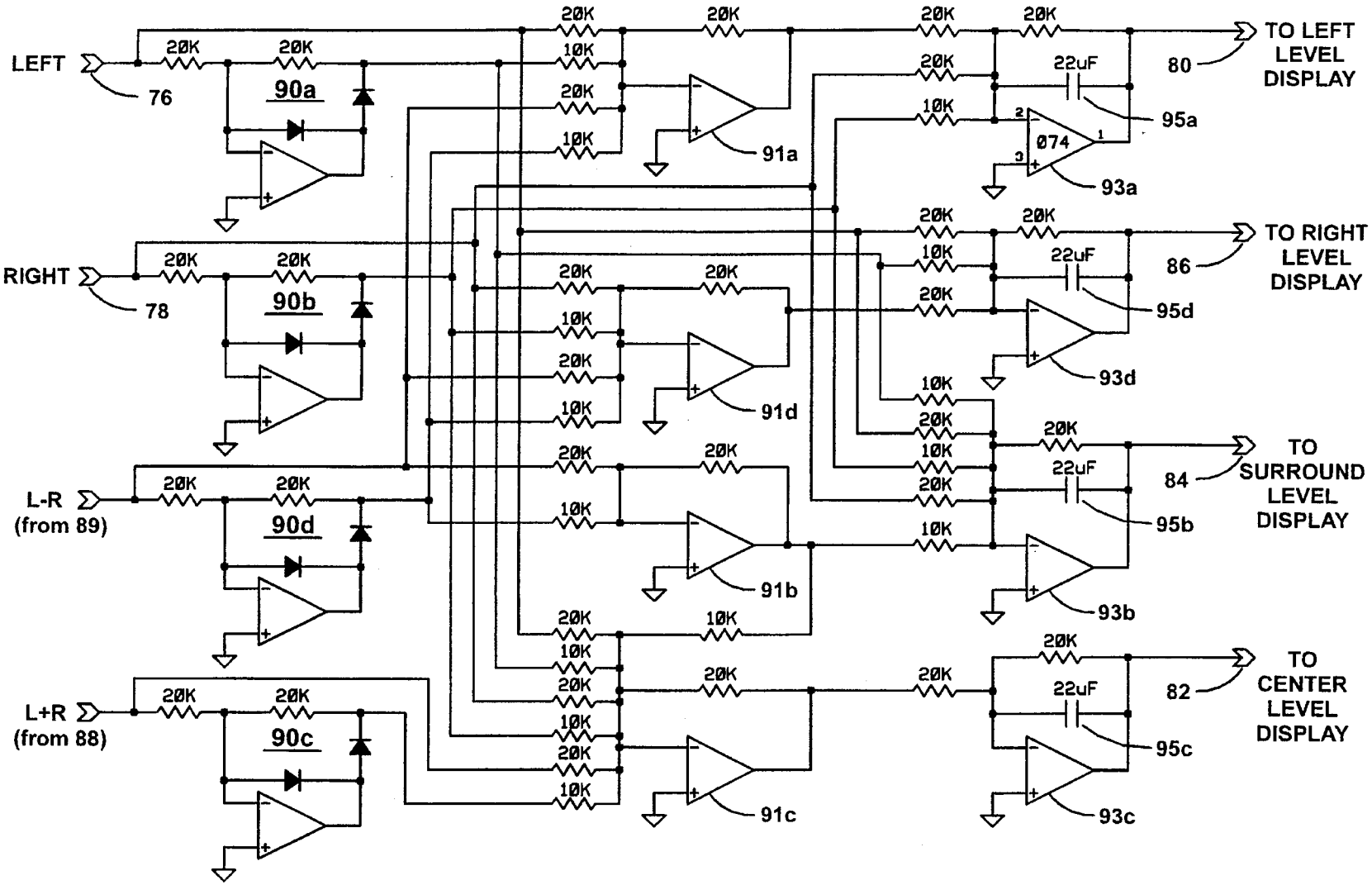
FIG. 10 is an electrical circuit diagram of the audio-image analyzer in FIG. 5.

The use of a variable linear-matrix factor M allows the user to expand or contract the image to accommodate the composition mixing of the source program. In order to determine the composition of a program source, an audio-image analyzer 74 may be provided (FIGS. 5 and 10). Stereo program image analyzer 74 has a left input 76 which is connected with the left channel of a stereo source and a right input 78, which is connected with the right channel of the stereo source. Image analyzer 74 produces an output 80 designated Ld, an output 82 designated Cd, an output 84 designated Sd, and an output 86 designated Rd. Outputs 80–86 may be applied to conventional display elements (not shown) in order to indicate the level of the signal on each of the outputs 80–86. Alternatively, outputs 80–86 may be utilized to determine the matrix value M for use with a variable image matrix 26, 26' by applying the values of outputs 80–86 to the matrix equations and solve for the variable M. Once M is determined, the value may then be applied to the variable image matrix 26, 26' in order to produce an image width that is optimal for the mixing of the program to which the listener is listening.

The functional equations which determine the display output are as follows:

$$Ld=X*\mathrm{AVG}(|L|-|R|+|S|)$$

$$Rd=X*\mathrm{AVG}(|R|-|L|+|S|)$$

$$Cd=Y*\mathrm{AVG}(|C|+|L|+|R|-2*|S|)$$

$$Sd=Z*\mathrm{AVG}(2*|S|-|L|-|R|)$$

where:

Ld=the left display signal

Rd=the right display signal

Cd=the center display signal

Sd=the surround display signal

L=the left program signal

R=the right program signal

C=L+R

S=L−R

X=a variable scaling factor, typically 0.56

Y=a variable scaling factor, typically 0.39

Z=a variable scaling factor, typically 0.79

|signal|=the absolute value of the signal, or the full-wave rectified signal

AVG(signal)=the time-average value of the signal, the averaging time constant being appropriate for audio signal levels (typically in the range of 100 ms to 2 s).

This may be accomplished by applying the left input 76, right input 78 and the sum 88 and difference 89 of the inputs to circuits 90*a*, 90*b*, 90*c* and 90*d* which determine the absolute value of such signal levels. The absolute value of the signals are combined either directly or after inversion by a combination network 92 and scaled with scaling amplifiers 94*a*, 94*b*, 94*c* and 94*d*. The outputs of scaling amplifiers 94*a*–94*d* are averaged with voltage averagers 96*a*, 96*b*, 96*c* and 96*d* to produce the respective outputs 80–86. An output signal of 0 volts represents no signal, and a more positive output voltage represents a higher signal level. Under some conditions, the output may go negative which values are considered 0. The purpose of scaling amplifiers 94*a*–94*d* is to allow the system to be calibrated to match the audio results of a real system. The averaging time constants of voltage averaging circuits 96*a*–96*d* may be any suitable value for averaging audio signals depending upon user preference and specific application and musical style. If the time constant is too small, then the display will become erratic and if it is too large then the response will be too long. An appropriate value is typically in the range of about 0.5 second to 2 seconds, depending on the program material.

This image analyzer system is intended to assist in the adjustment of the matrix factor for the imaging system. It can drive a level display which indicates the relative strength of the components within a stereo mix which are panned to left, center, right, and surround directions. One can see at a glance the relative level, not simply of the speaker drive signals, but of the actual imaged signals contained within the stereo program source. This allows very accurate adjustment of the matrix factor of the imager process, as well as the left-right balance of the program source, using visual feedback. One can precisely adjust the system for an optimum sonic result without having to be at any particular listening location, or even listening at all. This display is much more discriminating and precise than a simple level display of each of the three or four audio outputs used for driving the speakers.

Image analyzer 74 produces up to four output signals, which represent the levels of amplitude-panned signal components, from an original two-channel stereo mix. The outputs are intended to represent the audible balance of the directional components in the program source. Each output is a fluctuating voltage which may be used to control a level-display device, such as an LED ladder, or, in the case of computer-based systems, a video graphic display. Based on this display, adjustments in the reproducing system can be made to compensate for signal-transmission effects or personal taste in image presentation. The adjustments can also be made automatically by implementing a control-loop scheme in which the analyzer level outputs are used to directly control the imager-matrix adjustments to provide appropriate compensation.

A basic application of the image-analyzer system is in the adjustment of the imaging matrix factor in situations where the sound system itself either is not audible to the operator, or is not symmetrically audible to the operator. Another application is in the technical monitoring of an outgoing signal during a production, allowing a quick visual check of the resulting stereo program content. It can also be used for automatic control of the matrix factor for achieving correct stereo imaging and even sound distribution in an automated sound system.

Outputs 80, 82, 84, and 86 have an attenuation factor applied in order to restore the original level. The suggested values, shown above as X, Y, and Z, will result in an output value of one, for a single-frequency input signal (a sine wave) with an rms value of one (a peak value of 1.414), panned directly to any of the four directions. As described above, the center direction is achieved with equal signals at the left and right channels; the surround, or ambient, direction is achieved with left and right signals equal except with one of the signals inverted. When calibrated optimally, a source consisting of all four directional components intended to be at equal loudness, when reproduced with a correctly adjusted system with all four directional components at equal loudness, the system will show equal levels on all four display outputs.

FIG. 10 shows the preferred embodiment of the circuit which implements image analyzer 74. This circuit utilizes two-stage full-wave rectifier sections. In the rectifier sections, the signal's negative excursions are half-wave rectified and inverted at the first stages 90*a*–90*d*. Then, in second stages 91*a*–91*d*, the results are added, at a gain of two, to the original signal. Third summing stages 93*a*–93*d* are used to provide the required combination of terms. The second and third stages are also used as summing points for the terms of the process. This reduces the number of sections needed because it provides both polarities of summing points, accommodating both polarities of the terms. Because the third stages 93*a*–93*d* of each section are an inverting summing amplifier, capacitors 95*a*–95*d* in the feedback provide the averaging function. The averaging time constant is shown as 440 ms, which is rather fast and suitable for audio program material with popular styles of music. The outputs can be adjusted with trimmer potentiometers (not shown) to achieve the desired calibration, and then fed to a standard display driver circuit (not shown).

A calibration adjustment of imaging analyzer 74 can be accomplished by first making a recording or finding a program source with equal or appropriate audible balance of the four directions. Imaging analyzer 74 is then adjusted to achieve the correct equal balance. The individual display outputs may be calibrated to provide the desired equal readings of the four image-analyzer displays.

This invention is unique in its application of a combination of known phenomena to achieve a new level of performance and success. The combination of interchannel negative cross-mixing with a sum center-channel produces a major and highly significant improvement in audio-imaging results. Further, the ability to adjust and fine-tune the optimum matrix factor allows the system to operate optimally with any stereo program source allowing either manual or automatic compensation for the variations in image content among existing program sources, so that the sound distribution will be optimized for the playback system. Alternatively, the matrix factor can be preset according to speaker performance, room acoustics, and desired image width, and left at that setting. Then, any stereo program source will create a stereo image in accordance with the way it was originally recorded.

The described system is used advantageously in audio reproduction systems for providing correct sound-source localization, and increasing the size of the acceptable listening area, while maintaining an optimum level of separation and soundstage-image width. The system includes a suggested arrangement for the speakers, and the ability to adjust and optimize the signal output distribution. The matrix circuit can be applied in multiplicity to create multichannel extensions of the concept for special purposes, such as deriving stereo surround outputs, or utilizing more than two program source channels and more speakers than program source channels.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. An audio-imaging system comprising:

first and second input channels for receiving first and second channel audio input signals;

first, second, and third output channels for producing first, second, and third audio output signals as a function of signals applied to said first and second input channels; wherein said signal on said first, second, and third output channels are respectively a function of L–MR, R–Ml and (1–M)(L+R) where:

L: is the level of said signal applied to said first input,

R: is the level of said signal applied to said second input, and

M: is the value said parameter and said parameter is nonzero and a circuit that produces signals on each of said first, second, and third output channels as a function of a combination of said signals applied to said first and second input channels and said parameter, said parameter being common to said first, second, and third output signals, said parameter being adjustable by one of a user adjustment and an automatic adjustment in order to vary the width of the audio image produced by said signals to compensate for composition mixing of a program source applied to said input channels.

2. The audio-imaging system in claim 1, including an input device in order to receive a manual adjustment of said parameter.

3. The audio-imaging system in claim 2 wherein said input device is capable of varying said parameter within a range extending between −1 and +1.

4. The audio-imaging system in claim 1 wherein said first and second input channels are configured to receive left and right audio input signals of a stereophonic system and wherein said first, second, and third output channels are connected with left, right, and center forward speakers.

5. The audio-imaging system in claim 4, including third and fourth input channels connected with two of said first, second, and third output channels:

fourth, fifth, sixth, and seventh output channels for producing fourth, fifth, sixth, and seventh audio output signals as a function of signals applied to said third and fourth input channels, and a circuit that produces signals on each of said fourth, fifth, sixth, and seventh output channels as a function of a combination of said signals applied to said third and fourth inputs and another parameter, said another parameter being common to said fourth, fifth, sixth, and seventh audio output signals.

6. The audio-imaging system in claim 1, including a sound-image analyzer for determining image signal levels of a first channel signal, a second channel signal, and a mixture of said first and second channel signals in a program, said levels being fully separated whereby a value of said parameter may be determined for a program and used to automatically adjust the value of said parameter.

7. A audio-imaging system comprising:

first and second input channels for receiving first and second channel audio input signals;

first, second, and third output channels for producing first, second, and third audio output signals as a function of signals applied to said first and second input channels; and a circuit that produces a signal on said first output channel as a function of L−MR, a signal on said second output channel as a function of R−ML, and a signal on said third output channel as a function of (1−M)(L+R), wherein L is the level of said signal applied to said first input, R is the level of said signal applied to said second input, and M is a nonzero parameter.

8. The audio-imaging system in claim 7, wherein M is adjustable in order to vary the width of the audio image produced by said signals to compensate for composition mixing of a program source applied to said input channels.

9. The audio-imaging system in claim 8 wherein M is adjustable within a range extending between −1 and +1.

10. The audio-imaging system in claim 7 wherein said first and second input channels are configured to receive left and right audio input signals of a stereophonic system and wherein said first, second, and third output channels are connected with left, right, and center forward speakers.

11. An audio-imaging system comprising:

first, second, and third input channels for receiving first, second, and third channel audio input signals;

first, second, third, fourth, and fifth output channels for producing first, second, third, fourth, and fifth audio output signals as a function of signals applied to said first, second, and third input channels; and a circuit that produces a signal on said first output channel as a function of L−MC, a signal on said second output channel as a function of (1−M)(L+C), a signal on said third output channel as a function of C−M(R+L), a signal on said fourth output channel as a function of (1−M)(R+C), and a signal on said fifth output channel as a function of R−MC, wherein L is the level of said signal applied to said first input channel, R is the level of said signal applied to said second input channel, C is the level of said signal applied to said third input channel, and M is a nonzero parameter.

12. The audio-imaging system in claim 11, wherein M is adjustable in order to vary the width of the audio image produced by said signals to compensate for composition mixing of a program source applied to said input channels.

13. The audio-imaging system in claim 12 wherein M is adjustable within a range extending between −1 and +1.

14. The audio-imaging system in claim 11 wherein said first, second, and third input channels are configured to receive left, right, and center audio input signals and wherein said first, second, third, fourth, and fifth output channels are connected, respectively, with left, left-center, center, right-center, and right forward speakers.

15. An audio-imaging system comprising:

first, second, third, and fourth input channels for receiving first, second, third, and fourth channel audio input signals;

first, second, third, fourth, fifth, sixth, seventh, and eighth output channels for producing first, second, third, fourth, fifth, sixth, seventh, and eighth audio output signals as a function of signals applied to said first, second, third, and fourth inputs; and a circuit that produces a signal on said first output channel as a function of A−M(B+D), a signal on said second output channel as a function of (1−M)(A+B), a signal on said third output as a function of B−M(A+C), a signal on said fourth output channel as a function of (1−M)(B+C), a signal on said fifth output channel as a function of C−M(B+C), a signal on said sixth output channel as a function of (1−M)(C+D), a signal on said seventh output channel as a function of D−M(A+C), and a signal on said eighth output channel as a function of (1−M)(A+D), wherein A, B, C, and D are the levels of said signals applied, respectively, to said first, second, third, and fourth input channels and M is a nonzero parameter.

16. The audio-imaging system in claim 15, wherein M is adjustable in order to vary the width of the audio image produced by said signals to composition mixing of a program source applied to said input channels.

17. The audio-imaging system in claim 16 wherein M is adjustable within a range extending between −1 and +1.

18. The audio-imaging system in claim 15 wherein said first, third, fifth, and seventh output channels are connected, respectively, with speakers each positioned in a corner of a listening space and wherein said second, fourth, sixth, and eighth output channels are connected with speakers each positioned between two different ones of said speakers positioned in a corner.

19. An audio-imaging system comprising:

first, second, third, and fourth input channels for receiving first, second, third, and fourth channel audio input signals;

first, second, third, fourth, fifth, sixth, seventh, eighth, and ninth output channels for producing first, second, third, fourth, fifth, sixth, seventh, eighth, and ninth audio output signals as a function of signals applied to said first, second, third, and fourth input channels; and a circuit that produces a signal on said first output channel as a function of A−M(B+D), a signal on said second output channel as a function of (1−M)(A+B)−M(1−M)(C+D), a signal on said third output channel as a function of (1−M)(C+D)−M(1−M)(A+B), a signal on said fourth output channel as a function of B−M(A+C), a signal on said fifth output channel as a function of C−M(B+D), a signal on said sixth output channel as a function (1−M)(B+C)−M(1−M)(A+D), a signal on said seventh output channel as a function of (1−M)(1−M)(A+B+C+D), a signal on said eighth output channel as a function of (1−M)(A+D)−M(1−M)(B+C) and a signal on said ninth output channel as a function of D−M(A+C), wherein A, B, C, and D are the levels of said signals applied respectively to said first, second, third, and fourth inputs and M is a nonzero parameter.

20. The audio-imaging system in claim 19, wherein M is adjustable in order to vary the width of the audio image produced by said signals to compensate for composition mixing of a program source applied to said input channels.

21. The audio-imaging system in claim 20 wherein M is adjustable within a range extending between −1 and +1.

22. The audio-imaging system in claim 19 wherein said first, fourth, fifth, and ninth output channels are connected, respectively, with speakers positioned in corners of a listening space and wherein said second, third, sixth, and eighth output channels are connected with speakers each positioned between two different ones of the corner speakers and wherein said seventh output is connected with a speaker in the center of the other said speakers.

23. The audio-imaging system in claim 22 wherein said speakers are arranged in a vertical pattern.

24. An audio-imaging system comprising:

first and second input channels for receiving left and right channel audio input signals of a stereophonic system;

first, second, and third output channels for producing left, right and center audio output signals;

a circuit that produces signals on each of said first, second, and third output channel as a function of a combination of said signals applied to said first and second input channels and a parameter, said parameter being common to said first, second, and third output signals; and a sound-image analyzer which processes a program source applied to said input channels to at least three fully separated levels representing left, right and center directions, respectively, of said program source, said left, right and center directions representing an image of the program source, wherein said image analyzer determines a value of said parameter as a function of said left, right and center directions, wherein said parameter of said circuit can be adjusted in response to the image of said program source.

25. The audio-imaging system in claim 24, including a display for said levels.

26. The audio-imaging system in claim 24, wherein said sound-image analyzer is connected with said circuit in a control-loop whereby said levels are used to directly control the value of said parameter to adjust said parameter as a function of said levels.

27. The audio-imaging system in claim 24 including means for determining:

$$Ld=X*(\mathrm{Avg}(|L|-|R|+|L-R|)),$$

$$Rd=X*(\mathrm{Avg}(|R|-|L|+|L-R|)),$$

$$Cd=Y*(\mathrm{Avg}(|L+R|+|L|+|R|-2*|L-R|)),$$

where:

R is the program left channel signal,

L is the program right channel signal,

Ld is a left channel level determined by the analyzer,

Rd is a fight channel level determined by the analyzer,

Cd is a center channel level determined by the analyzer, and

X and Y are numbers.

28. The audio-imaging system in claim 27 further including means for determining:

$$Sd=Z*(\mathrm{Avg}(2*|L-R|-|L|-|R|))$$

where Sd is an ambient audio level determined by the analyzer, and Z is a number.

29. An audio-image analyzer comprising:

first and second input channels for receiving left and right channel audio input signals of a stereophonic system;

a circuit which processes a program source applied to said first and second input channels to at least three fully separated levels representing left, right and center directions, respectively, or said program source, wherein said circuit determines:

$$Ld=X*(\mathrm{Avg}(|L|-|R|+|L-R|)),$$

$$Rd=X*(\mathrm{Avg}(|R|-|L|+|L-R|)),$$

$$Cd=Y(\mathrm{Avg}(|L+R|+|L|+|R|-2|L-R|)),$$

where:

R is the program source left channel signal,

L is the program source right channel signal,

Ld is said left direction,

Rd is said right direction,

Cd is said same direction,

X is a first scaling factor, and

Y is a second scaling factor.

30. The image analyzer in claim 29 further including means for determining $$Cd=Y*(\mathrm{Avg}(|L+R|+|L|+|R|-2*|L-R|))$$

where Cd is a center channel level determined by the analyzer, and Y is a number.

31. The image analyzer in claim 30 further including means for determining:

$$Sd=Z*(\mathrm{Avg}(2*|L-R|-|L|-|R|))$$

where Sd is an ambient audio level determined by the analyzer, and Z is a number.

32. The image analyzer in claim 29, including a display for said levels.

33. A method of imaging a multiple-channel audio program including:

receiving first and second channel audio input signals;

producing first, second, and third audio output signals as a combination of said first and second audio signals and a nonzero parameter, said parameter being common to said first, second and third output signals; wherein said signal on said first, second, and third outputs are, respectively, a function of L−MR, R−ML and (1−M)(L+R) where:

L: is the level of said first audio signal,

R: is the level of said second audio signal, and

M: is the value of said parameter: and adjusting said parameter by one of a user adjustment and an automatic adjustment in order to vary the width of the audio image produced by said first and second channel audio input signals to compensate for composition mixing of a program source making up said audio input signals.

34. The method of claim 33, including adjusting said parameter within a range extending between −1 and +1.

35. The method of claim 33, including applying said first, second, and third outputs to left, right, and center forward speakers.

36. The method of claim 33, including analyzing the audio program from which said first and second audio signals are derived and determining fully separated levels of a first channel signal, a second channel signal, and a mixture of said first and second channel signals which represent the directional components establishing the image in said program whereby a value of said parameter may be determined for said program.

37. The method of claim 36, including displaying said levels.

38. The method of claim 36, including automatically adjusting said number in response to said levels.

* * * * *

UNITED STATES PATENT AND TRADEMARK OFFICE

CERTIFICATE OF CORRECTION

PATENT NO. : 5,610,986
DATED : March 11, 1997
INVENTOR(S) : Michael T. Miles

It is certified that error appears in the above-identified patent and that said Letters Patent is hereby corrected as shown below:

Column 18, claim 16,
Line 43, insert -- compensate for -- before "composition".

Column 19, claim 24,
Line 37, insert -- nonzero -- before "parameter" in the first occurrence.

Column 20, claim 27,
Line 2, "fight" should be -- right --.

Column 20, claim 29,
Line 34, "same" should be -- center --.
Line 26, insert -- * -- after "Y"

Signed and Sealed this

Eighth Day of January, 2002

*Attest:*

*Attesting Officer*

JAMES E. ROGAN
*Director of the United States Patent and Trademark Office*